US007599255B2

(12) United States Patent
Kent

(10) Patent No.: US 7,599,255 B2
(45) Date of Patent: Oct. 6, 2009

(54) DEVICE FOR DISPLAYING TIME IN SELECTABLE DISPLAY PATTERNS AND METHOD OF USING THE SAME

(76) Inventor: Dennis C. Kent, 23226 Surrey Way, California, MD (US) 20619

( * ) Notice: Subject to any disclaimer, the term of this patent is extended or adjusted under 35 U.S.C. 154(b) by 450 days.

(21) Appl. No.: 11/340,464

(22) Filed: Jan. 27, 2006

(65) Prior Publication Data

US 2006/0126439 A1 Jun. 15, 2006

Related U.S. Application Data

(63) Continuation-in-part of application No. 11/108,786, filed on Apr. 19, 2005, now abandoned, which is a continuation of application No. 10/655,347, filed on Sep. 5, 2003, now Pat. No. 6,882,597.

(51) Int. Cl.
*G04C 19/00* (2006.01)
*G04C 17/00* (2006.01)

(52) U.S. Cl. ..... 368/82; 369/223; 369/239

(58) Field of Classification Search ..... 368/26–30, 368/76, 82–84, 223, 229, 239, 241, 242, 368/327

See application file for complete search history.

(56) References Cited

U.S. PATENT DOCUMENTS

| | | | | |
|---|---|---|---|---|
| 3,744,235 | A * | 7/1973 | Kratomi | 368/79 |
| 3,775,964 | A | 12/1973 | Fukumoto | |
| 3,958,409 | A | 5/1976 | Manber | |
| 4,757,484 | A | 7/1988 | Pardo | |
| 4,872,150 | A * | 10/1989 | Norman | 368/223 |
| 4,920,524 | A * | 4/1990 | Kotob | 368/240 |
| 5,008,870 | A | 4/1991 | Vessa | |
| 5,228,013 | A * | 7/1993 | Bik | 368/223 |
| 5,455,808 | A * | 10/1995 | Grupp et al. | 368/82 |
| 5,526,327 | A * | 6/1996 | Cordova, Jr. | 368/82 |
| 5,636,185 | A | 6/1997 | Brewer et al. | |
| 5,694,376 | A | 12/1997 | Sullivan | |
| 5,818,798 | A | 10/1998 | Luchun | |
| 5,838,643 | A * | 11/1998 | Reiner | 368/223 |
| 5,896,348 | A | 4/1999 | Lyon | |
| 2002/0031051 | A1 | 3/2002 | Emami | |
| 2002/0196711 | A1 | 12/2002 | Guhl | |

FOREIGN PATENT DOCUMENTS

| | | |
|---|---|---|
| DE | 4111415 | 10/1992 |
| DE | 4135514 | 2/1993 |
| DE | 4134709 | 4/1993 |
| EP | 0650110 A1 | 4/1995 |
| FR | 2646534 | 11/1990 |

* cited by examiner

*Primary Examiner*—Vit W Miska
(74) *Attorney, Agent, or Firm*—Richard C. Litman

(57) ABSTRACT

The device for displaying time in selectable display patterns includes a storage device, an interface, a housing, display elements, and a controller. The storage device stores selectable display patterns. The interface receives an input to select a display pattern. The housing contains a display area that displays the selected display pattern. The display elements may include hour display elements, minute display elements, second display elements, day display elements, date display elements, and/or month display elements. Time is displayed by the amount of display elements in the exhibiting state.

2 Claims, 25 Drawing Sheets

DEVICE FOR DISPLAYING TIME IN SELECTABLE DISPLAY PATTERNS AND METHOD OF USING THE SAME

CROSS-REFERENCE TO RELATED APPLICATIONS

This application is a continuation-in-part of U.S. application Ser. No. 11/108,786, filed on Apr. 19, 2005, now abandoned which is a continuation of U.S. application Ser. No. 10/655,347, filed on Sep. 5, 2003, now U.S. Pat. No. 6,882,597.

BACKGROUND OF THE INVENTION

1. Field of the Invention

The present invention relates generally to the representation and display of time. More specifically, the present invention relates to a device adapted for displaying time in the form of a selectable display pattern.

2. Description of the Related Art

Throughout history, people have tried to display time. First, there were primitive sundials, then mechanical clocks, and now digital clocks.

Children struggle to learn how to tell time when first exposed to either traditional mechanical clocks or digital numerical presentations of the time of day. Consequently, a need has been felt for providing an alternative method of presenting information about the time of day that is customizable, flexible, changeable, and readily understandable. The present invention would be another means of telling time after the mechanical and digital timepieces in widespread use today.

U.S. Pat. No. 3,775,964, issued Dec. 4, 1973 to Fukumoto, describes a time-indicating apparatus using neither figures nor pointers, wherein the time-indicating plane is divided into the hour, minute and second indicating sections of a multiple of twelve and electric lamps or the like provided inside said sections are turned on or off by means of a switch connected to the clock mechanism to indicate the time by illuminating said sections successively.

U.S. Pat. No. 3,958,409, issued May 25, 1976 to Manber, describes a watch display including first and second concentric circular arrays of light emitting diodes which are sequentially energized to indicate the minutes and hours such that only one diode from each array is energized at any one time.

U.S. Pat. No. 4,757,484, issued Jul. 12, 1988 to Pardo, describes a clock device having a hollow housing bearing readily viewable adjacent first, second and illuminatable display panels. The first panel bears the hour display element and an inverted V indicating zero, four dots indicating ones and two horizontal bars each indicating five. The second panel is the tens of minutes display element and bears four dots and one horizontal bar, while the fifth panel is the minutes display element and bears an inverted V, four dots and one horizontal bar. The device can also include a similar temperature measuring and display mechanism, with separate fourth, fifth and sixth display panels bearing Mayan symbols, and + and − symbols, with switches to cause the device to alternately or simultaneously display the time and temperature.

U.S. Pat. No. 4,872,150, issued Oct. 3, 1989 to Norman, describes an apparatus for conveying time and date information by way of at least one array. Each array contains at least one pictorial image presented on a plane having no visible fittings, and each of the pictorial images has no meaning attached to its shape but by its presence in an array indicating the integer 1 and by one of its absence and its diminishment indicating the integer 0. Each of the arrays represents a binary number indicating at least one of seconds, minutes, hours, days of the week, days of the month, months, seasons and years. The image in the array is positioned relative to a reference not forming part of the array and not forming part of the image in the array not withstanding the presence, absence or diminishment of other images in any array.

U.S. Pat. No. 4,920,524, issued Apr. 24, 1990 to Kotob, describes a timepiece such that the dial of the timepiece is provided with a first circular array of twelve blue LEDs indicating hours, a second next-outermost array of sixty red LEDs indicating minutes, and a third next-outermost array of sixty green LEDs indicating seconds. Every fifth red "minute" LED is distinct from the intermediate "minute" LEDs in that it is either spaced farther apart from the adjacent LEDs or is larger than the adjacent LEDs, or both. A switch is provided in the timing circuit of the timepiece to select between a "normal" mode of operation wherein the sixty "minute" LEDs are energized in sequence, at the passage of each minute and a "teaching" mode of operation wherein only every fifth "minute" LED is energized, in sequence, at the passage of each five minute interval.

U.S. Pat. No. 5,008,870, issued Apr. 16, 1991 to Vessa, describes an electronic timepiece having a display with a center position and twelve columns. Each column has at least five display elements extending in a radial direction from the center position. The display elements of each column define at least five concentric rows. One of the rows defines a five minute hand row and another row defines an hour row. The minutes are displayed along each radial column to represent time periods of from one to four minutes with the fifth being indicated by the five minute display elements.

U.S. Pat. No. 5,228,013, issued Jul. 13, 1993 to Bik, describes a microelectronic-based timekeeping apparatus having several display means that change color to indicate the time-of-day, and user accessible switches for setting modes of operation. The apparatus and switches are mounted within an aluminum frame.

U.S. Pat. No. 5,526,327, issued Jun. 11, 1996 to Cordova, Jr., describes a display and method for depicting the passage of time by selectively and progressively filling predetermined areas, where each area represents hours, minutes, seconds and tenths of seconds, respectively. The areas may be of any shape or combination of shapes. The portion of the area that is filled represents that portion of an hour, minute, second or tenth of second that has passed. The areas may be normally dark in which case filling illuminates the area, or may be normally light in which case filling darkens the area. The areas may be arranged in unconventional and discontinuous patterns and incorporated into a wide variety of objects.

U.S. Pat. No. 5,636,185, issued Jun. 3, 1997 to Brewer, et al., describes a dynamically changing, multi-color liquid crystal display for electronic watches or other design apparel items. The display can be adapted to provide various colored images such as geometric images, animation images, customized images, designer labels, logos, etc. on colored backgrounds or, alternatively, provides a color changing capability that is aesthetically pleasing and fashionable. Moreover, the dynamically changing watch or other designer apparel item allows for the electronic control of the color appearance of the liquid crystal display as well as electronic control of the liquid crystal display images, such images being generally independent of the time of day.

U.S. Pat. No. 5,694,376, issued Dec. 2, 1997 to Sullivan, describes a method and device for displaying time using a single segment member where the length and position of the segment member reflects the time. The device generally comprises a timer circuit to set and maintain hours and minutes of time, and a segment member control circuit which is responsive to the timer circuit and adjusts the length and position of the segment member to reflect the time maintained by the timer circuit.

U.S. Pat. No. 5,818,798, issued Oct. 6, 1998 to Luchun, describes a timepiece having a novel display with an integral alphanumeric display, which includes alternating light and dark bands to assist in the determination by a user of the current time. The display includes two columns of a dozen hourly display elements each for indicating the current hour. Located around the perimeter of the display is a ring of sixty minute display elements. The timepiece includes a message receiver for decoding conventional paging protocols received through an RF antenna.

U.S. Pat. No. 5,838,643, issued Nov. 17, 1998 to Reiner, describes a timepiece comprising a face having a polygonal configuration when viewed in plan and a timekeeping mechanism coupled with the face. Means for indicating the hour of time, the minute of the hour, the day of the month, and the seconds of the hour are provided along the sides of the polygon.

U.S. Pat. No. 5,896,348, issued Apr. 20, 1999 to Lyon, describes a novel method or convention of tracking and displaying the passage of time. Three groups of display elements are used and each group is distinguishable from the other two groups. Each display element is capable of displaying one of two states and can be readily switched between the two states. The first group consists of twelve display elements to indicate the hours. The second group consists of five display elements to indicate the passage of multiples of ten minutes. The third group consists of nine display elements to indicate the passage of minutes.

U.S. Patent Publication No. 20020031051, published Mar. 14, 2002 to Emami, describes a watch, wherein the time is represented by a plurality of display means that are individually activated or deactivated. The watch includes a first group of display means for the number of hours, a second group of display means for a first position of the number of minutes and a third group for the second position of the number of minutes. The display means in each group preferably form at least three subgroups, wherein the groups and subgroups are arranged in such a way that they can be separately and optically perceived and the amount of display means activated in a group correspond to a figure redisplaying the time.

U.S. Patent Publication No. 20020196711, published Dec. 26, 2002 to Guhl, describes a watch having a digital or analogue time display and a device for displaying Chinese depictions by means of a display element. The display element displays the twelve Chinese life symbols and is designed such that it visually reveals one life symbol in each case for a time period of two hours, the respectively visible depiction correlating with a specific time display.

German Patent No. 4,111,415, published October 1992, describes an apparatus that displays time in the usual hours, minutes and seconds format. A quinary system of indication is used with a matrix of identical illuminated units. A right-hand vertical column indicates the numbers 1 to 4, a central column indicates the numbers 5, 10, 15, and 20, and a left-hand column indicates the numbers 25 or 50 to complete a minutes/seconds display. The hours 1 to 24 are displayed in a separate 2 column matrix in similar quinary fashion.

German Patent No. 4,135,514, published Feb. 25, 1993, describes an apparatus having a main surface with a display element which is movable relative to it. The main surface represents a complete time cycle, for example, a day, and the display element is superimposed on it. The display element maybe brighter than, or a different color to the main surface, and shows the actual time.

German Patent No. 4,134,709, published Apr. 22, 1993, describes a method involving using a visual symbol to represent each decimal figure (0-9) in a single or multi-digit number, for example, by illuminating selected LEDs in rows redisplaying hours, minutes, seconds or days, months, years. The method may take account of decimal placing of the numbers.

Japanese Patent No. 2002-98,782, published Apr. 5, 2002, describes a method for color-coding the time into hours, minutes and seconds and displaying them by fourteen display windows. The time is displayed by display windows for hours, minutes, and seconds, a minute interpolation display window and a second interpolation window. In the display windows, for example, primary color LEDs are used, and red color for hour display, green color for minute display and blue color for second display are distributed to display the hour, the minutes in five minute units, and the seconds in five second units by lighting positions of respective colors. The minute interpolation display window represents minutes dividable by five minutes, such as five minutes, ten minutes, and fifteen minutes when not lighted, sequentially lights the next minute in white, the next minute in red, the next minute in green and the next minute in blue, and displays sixty minutes in one minute units together with the twelve display windows of five minute units.

None of the above inventions and patents, taken either singly or in combination, is seen to describe the instant invention as claimed. Thus, a device for displaying time solving the aforementioned problems is desired.

SUMMARY OF THE INVENTION

The present invention is a device adapted for displaying time in the form of a selectable display pattern. In a first embodiment, the device includes a storage device, an interface, a housing containing a display area, a plurality of display elements, and a display elements controller.

The storage device is adapted for storing at least one selectable display pattern, and may be contained within the housing. The selectable display patterns can be customized to the operator's and/or manufacturer's tastes or preferences. The interface is adapted for accepting at least one input from the operator and/or manufacturer, and may be contained within or secured to the housing. In response to the input, the interface preferably communicates with the controller such that the at least one selectable display pattern is selected.

The housing contains a display area or background that is adapted for displaying the selected selectable display pattern.

The plurality of display elements includes a plurality of hour display elements and a plurality of minute display elements located proximate to the display area. The plurality of display elements may further include a plurality of second display elements, a plurality of day display elements, a plurality of date display elements, and/or a plurality of month display elements located proximate to the display area.

The amount of display elements of the hour display elements being in an exhibiting state indicates an elapsed number of hours in a day. The amount of display elements of the minute display elements being in an exhibiting state indicates an elapsed number of minutes in an hour. The amount of display elements of the second display elements being in an exhibiting state indicates an elapsed number of seconds in a minute. The amount of display elements of the day display elements being in an exhibiting state indicates an elapsed number of days in a week. The amount of display elements of the date display elements being in an exhibiting state indicates an elapsed number of days in a month. The amount of display elements of the month display elements being in an exhibiting state indicates an elapsed number of months in a year.

The controller is in communication with a time mechanism, the storage device, and the interface, and may be contained within the housing. Also, the controller is in operable communication with the plurality of display elements. Further, the controller is adapted for receiving time signals from the time mechanism and, in response to the time signals, outputs display control signals to the plurality of display elements such that an hours group pattern, a minutes group pattern, a seconds group pattern, a days group pattern, a date group pattern, and/or a months group pattern, of the selected selectable display pattern are exhibited proximate to the display area.

Each of the group patterns of the selected selectable display pattern is of discrete and discernable contrast relative to the display area, and is visually distinguishable from one another.

A source of the exhibition of the plurality of display elements may be emitted light, reflected light, such as light reflected off of shutters, fluorescent light, or any illumination means or method.

In addition, the interface may be, or include, a pattern toggle member and/or a time display toggle member.

In the second embodiment, the device does not include the housing. Thus, the selected selectable display pattern is displayed or shown on a display area of a structure.

Furthermore, the device of the present invention is flexible in that it allows the operator and/or manufacturer to select another selectable display pattern when a different display pattern to be displayed is desired.

Accordingly, it is a principal object of the invention to provide a way of presenting information about the time of day that is customizable by an operator and/or manufacturer.

It is another object of the invention to provide a way of presenting information about the time of day that is customizable and changeable by an operator and/or manufacturer.

It is a further object of the invention to provide a way of presenting information about the time of day that is readily comprehensible by a viewer.

Still another object of the invention is to provide a way of presenting information about the time of day that is aesthetically appealing.

It is an object of the invention to provide improved elements and arrangements thereof for the purposes described which is inexpensive, dependable and fully effective in accomplishing its intended purposes.

These and other objects of the present invention will become readily apparent upon further review of the following specification and drawings.

BRIEF DESCRIPTION OF THE DRAWINGS

Similar reference characters denote corresponding features consistently throughout the attached drawings.

DETAILED DESCRIPTION OF THE PREFERRED EMBODIMENTS

Figure 1:
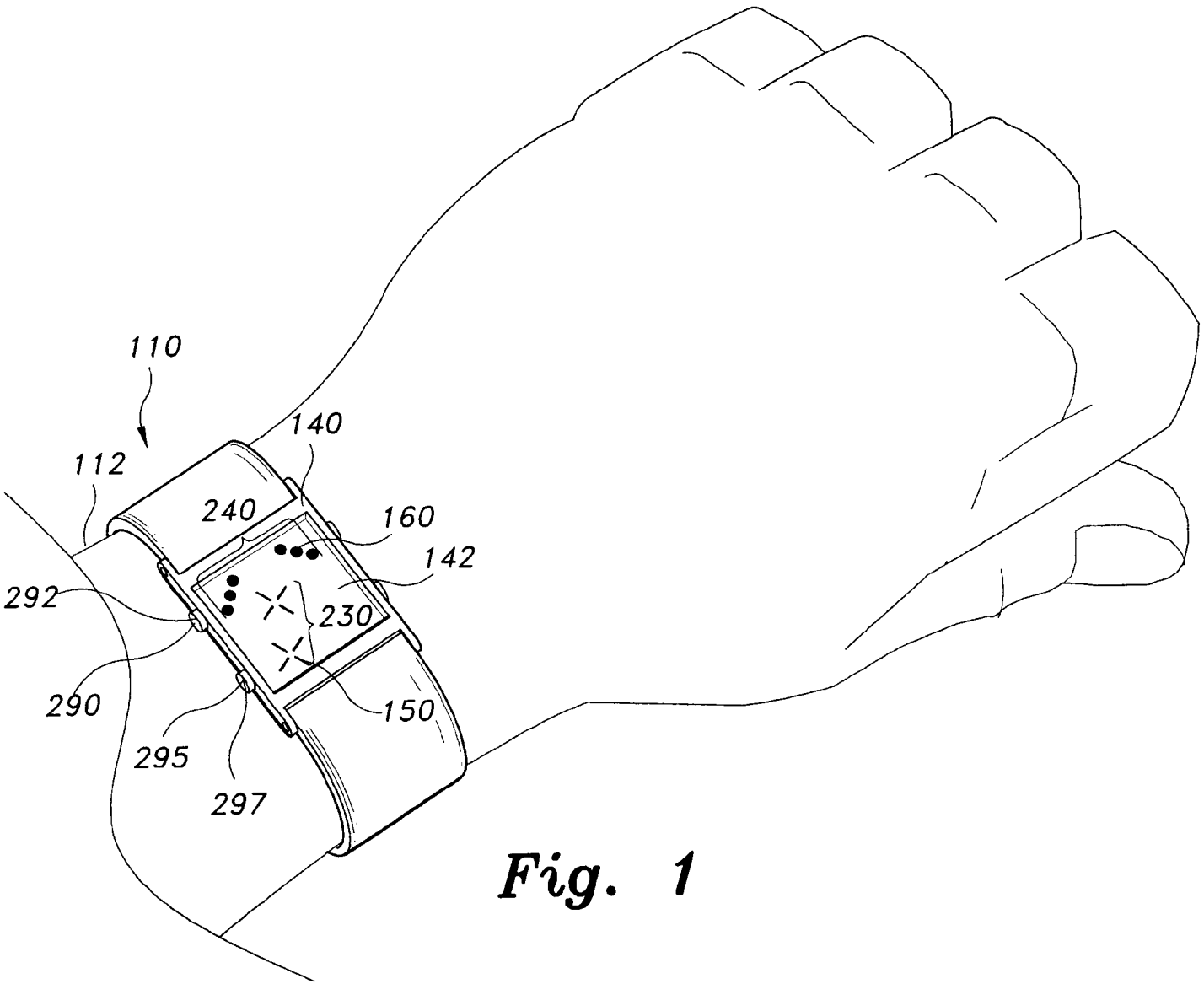
FIG. 1 is an environmental, perspective view of a device for displaying time according to the present invention, formed as a watch displaying time in hours and minutes.

Referring to FIGS. 1-16, the present invention is a device adapted for displaying time in the form of a selectable display pattern. In a first embodiment, the device 110 includes a storage device 120, an interface 130, a housing 140 containing a display area 142, a plurality of display elements, and a display elements controller 210. Examples of the first embodiment of the device 110 of the present invention are watches, wall clocks, desk clocks, digital bank clocks, clocks in automobiles and other types of vehicles, billboard type of clocks, such as one of the clocks located in Times Square in New York City, cellular telephones, personal computers, and any device, particularly related to electronics and/or communications, that includes a housing containing a display area and that desires to display or show time.

Figure 8:
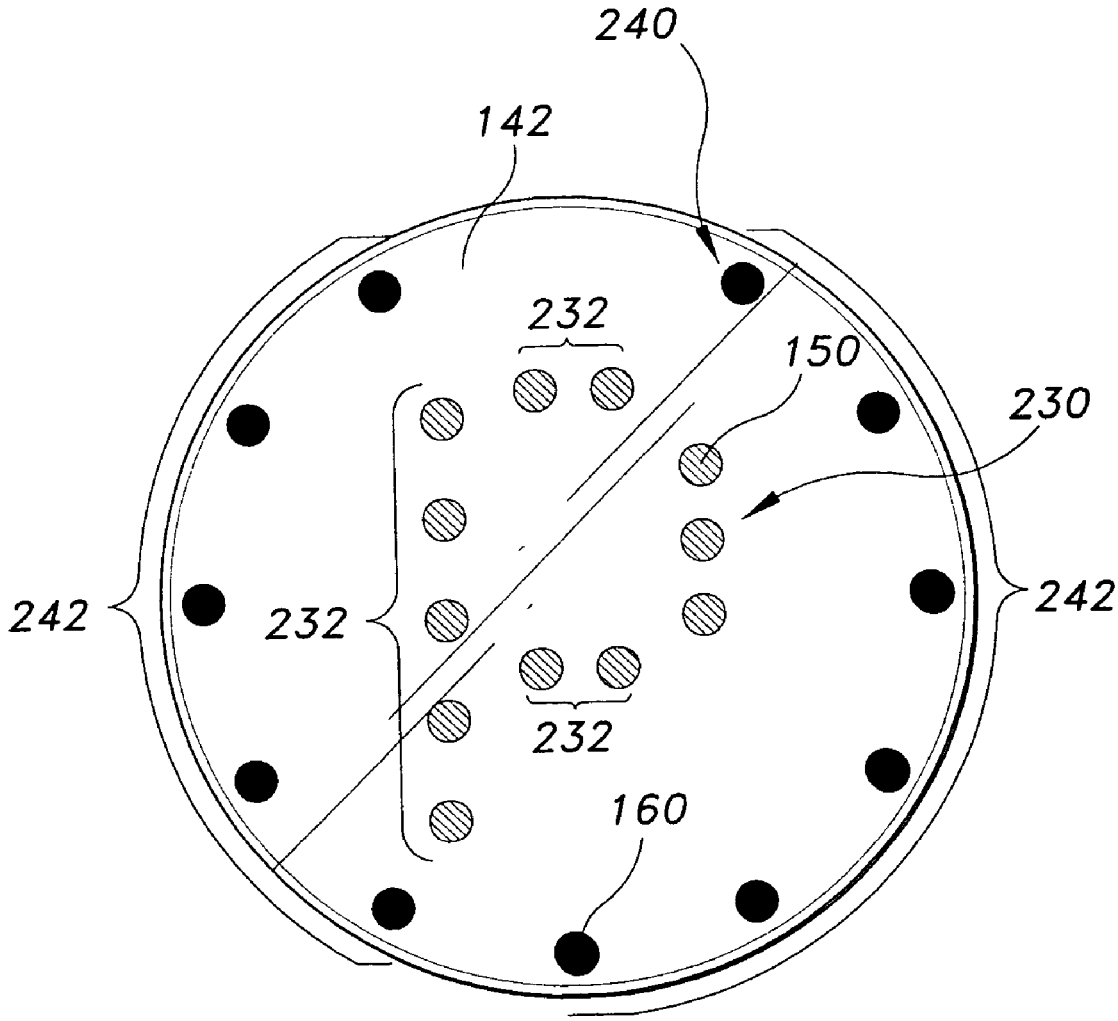
FIG. 8 is a top or front view of a device for displaying time according to the present invention, displaying time in the form of an hours group pattern and a minutes group pattern of another selectable display pattern.
Figure 9:
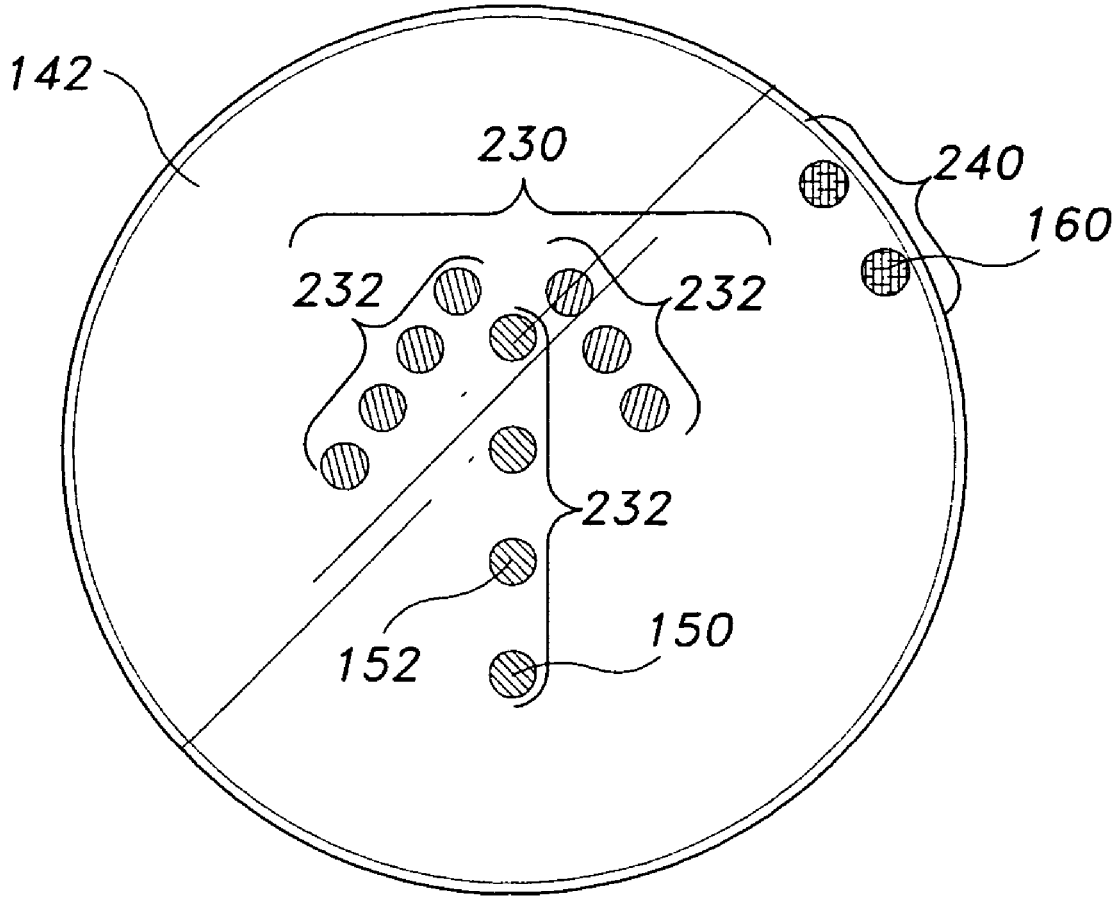
FIG. 9 is a top or front view of a device for displaying time according to the present invention, displaying time in the form of an hours group pattern and a minutes group pattern in A.M. time of another selectable display pattern.
Figure 10:
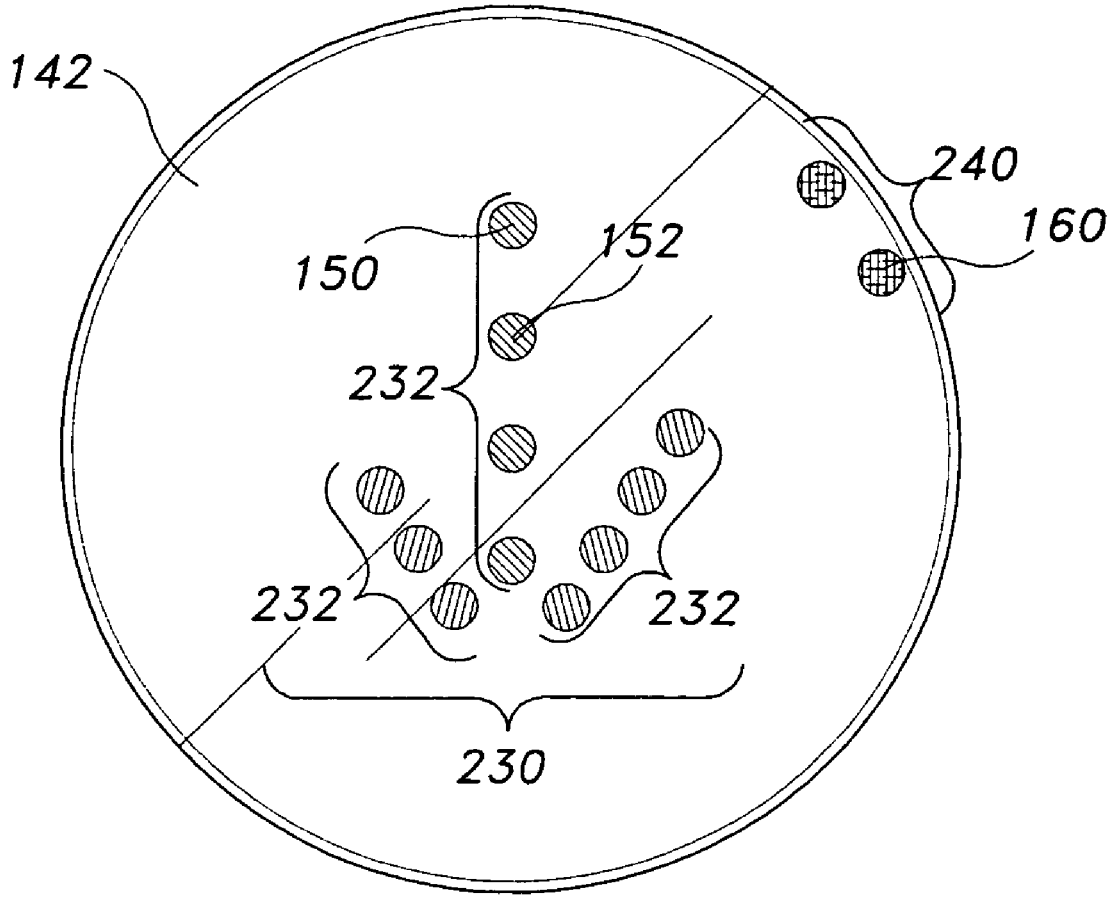
FIG. 10 is a top or front view of a device for displaying time according to the present invention, displaying time in the form of an hours group pattern and a minutes group pattern in P.M. time of the selectable display pattern of FIG. 9.
Figure 14:
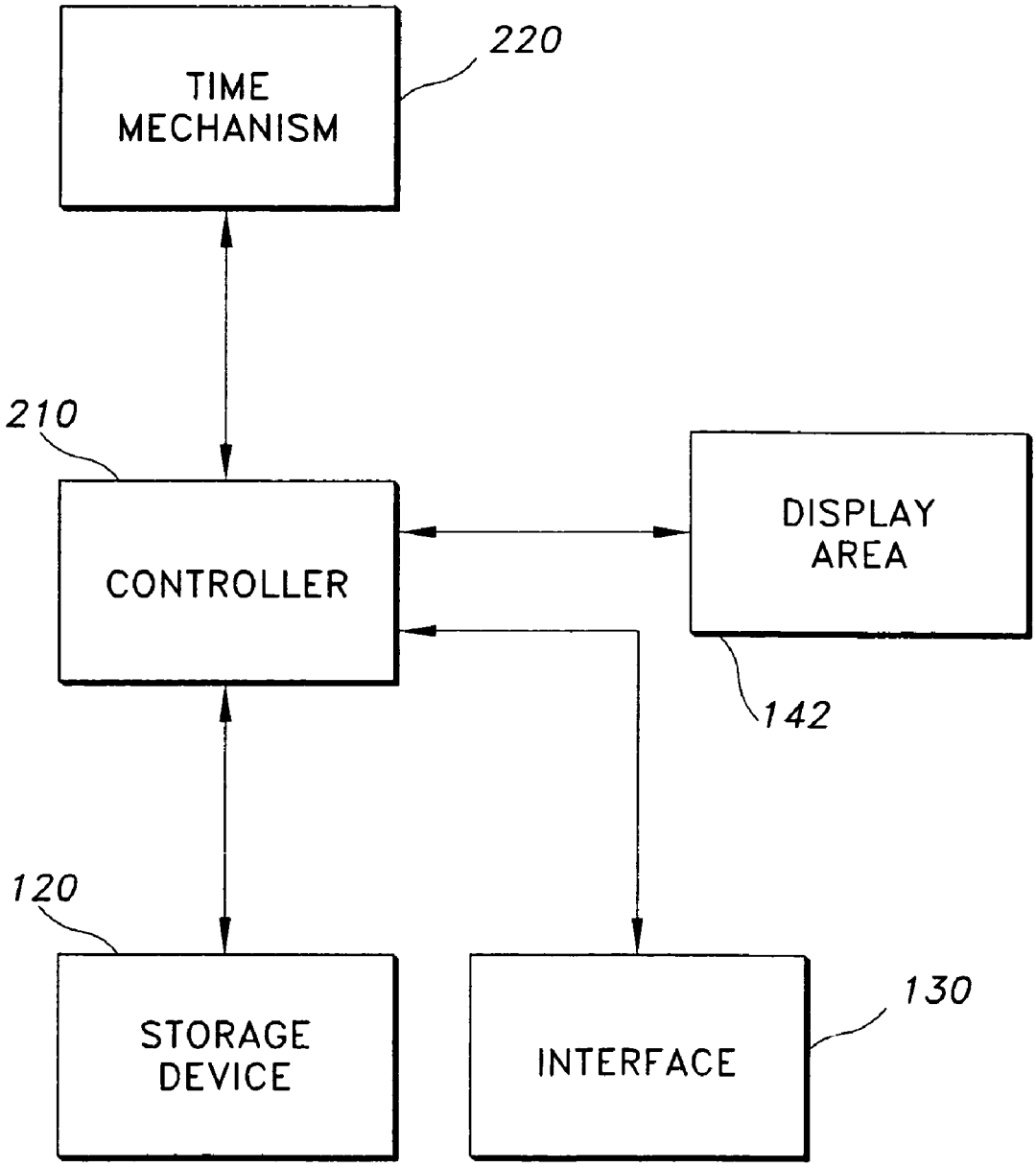
FIG. 14 shows a schematic of a device for displaying time according to the present invention.
Figure 15:
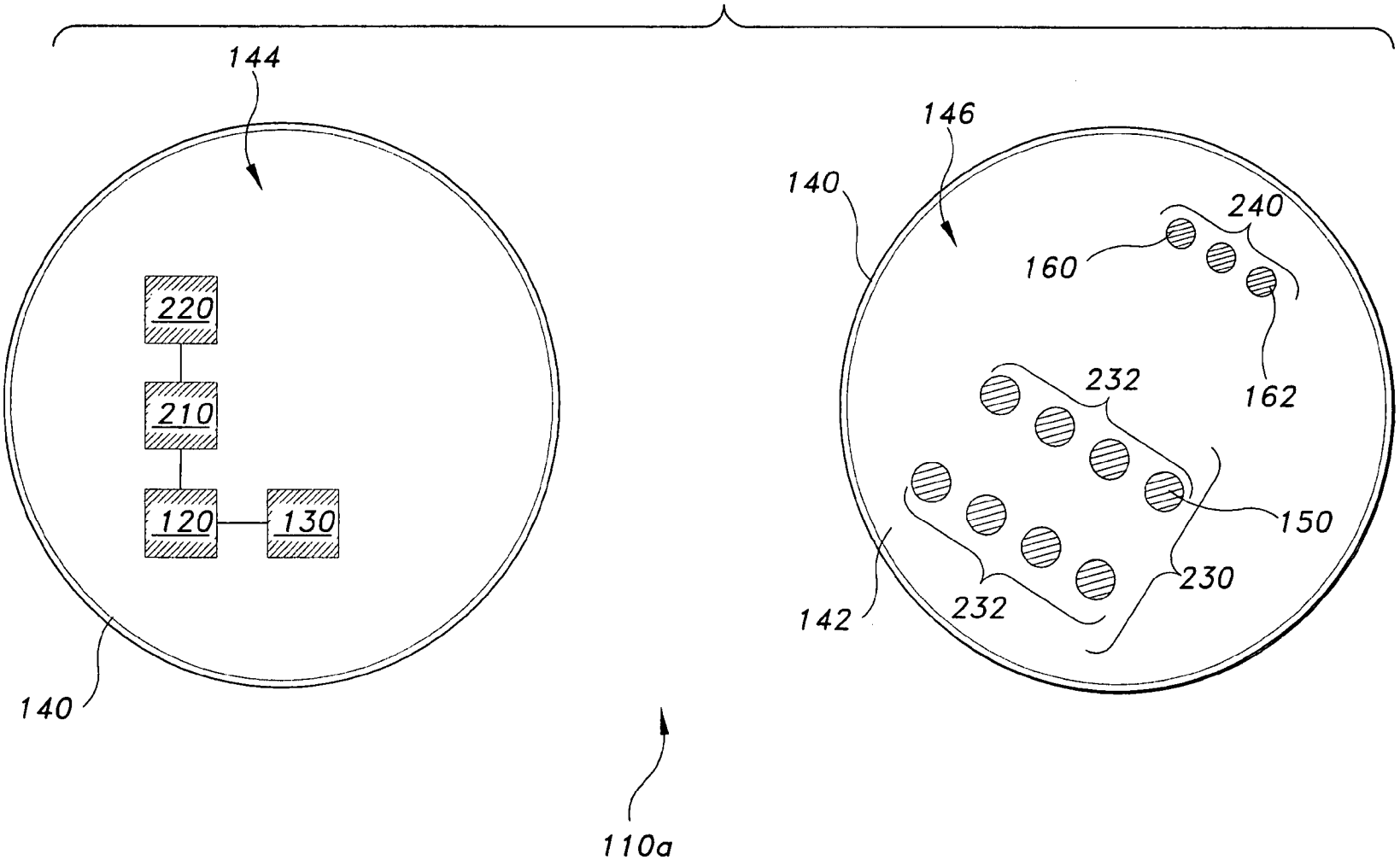
FIG. 15 shows the interior and exterior of a device for displaying time according to the present invention, as a watch displaying time in the form of an hours group pattern and a minutes group pattern of another selectable display pattern.

As shown in FIGS. 14 and 15, the storage device 120 is adapted for storing a plurality of selectable display patterns, and may be contained within the housing 140. The storage device 120 may be any known device known in the art that can store different selectable display patterns, which may have been programmed into or stored in the device by an individual user or operator 112 and/or manufacturer. The selectable display patterns can be customized to the operator's 112 and/or manufacturer's tastes or preferences, such as in the form of an upright pointed arrow (as shown in FIG. 9) indicating time in A.M. time, a downward pointed arrow (as shown in FIG. 10) indicating time in P.M. time, a sports ball, a cartoon character, or any other display pattern. Further, the operator 112 may prefer to customize the showing or display of time in a personal manner, such as depicting the first initial of their first and/or last name (as shown in FIG. 8).

As shown in FIGS. 14 and 15, the interface 130 is adapted for accepting at least one input from the operator 112 and/or manufacturer, and may be contained within or secured to the housing 140. In response to the input, the interface 130 preferably communicates with the controller 210 such that one of the selectable display patterns is selected. The interface 130 may be any known device known in the art.

As shown in FIGS. 1-7 and 15, the housing 140 contains a display area 142 or background that is adapted for displaying the selected selectable display pattern. Depending on what type of device the first embodiment of the present invention is manufactured as, the housing 140 may have one of a variety of different shapes and/or structures shown in FIGS. 1-7.

As shown in FIGS. 1, 2 and 4-16, the plurality of display elements includes a plurality of hour display elements 150 and a plurality of minute display elements 160 located proximate to the display area 142. The plurality of display elements may further include a plurality of second display elements 170, a plurality of day display elements 180, a plurality of date display elements 190, and/or a plurality of month display elements 200 located proximate to the display area 142. As examples, the plurality of display elements may be located on and/or below the display area 142. The plurality of display elements may be pixels of a liquid crystal display (LCD) or a light emitting diode (LED), and any other known display elements in the art.

Each hour display element 150 has at least an exhibiting state and a non-exhibiting state, and is for indication of 1 elapsed hour. As shown in FIGS. 1, 2, 4-12, 15 and 16, the amount of display elements of the hour display elements 150 being in the exhibiting state indicates an elapsed number of hours in a day. As examples, the number of hour display elements 150 may be 12 or 24 primary hour display elements 152.

Figure 5:
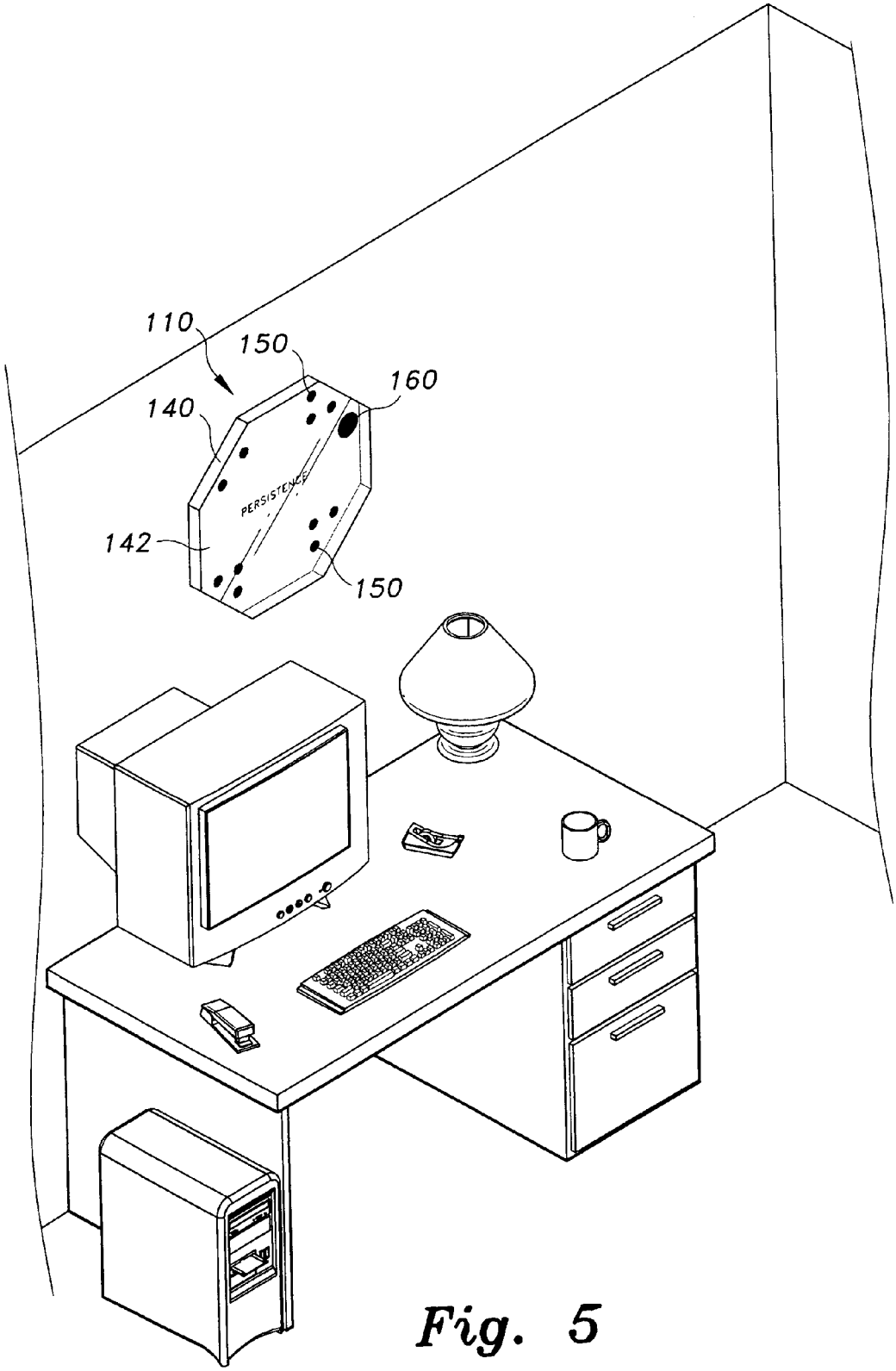
FIG. 5 is an environmental, perspective view of a device for displaying time according to the present invention, formed as a wall clock displaying time in hours and minutes.
Figure 6:
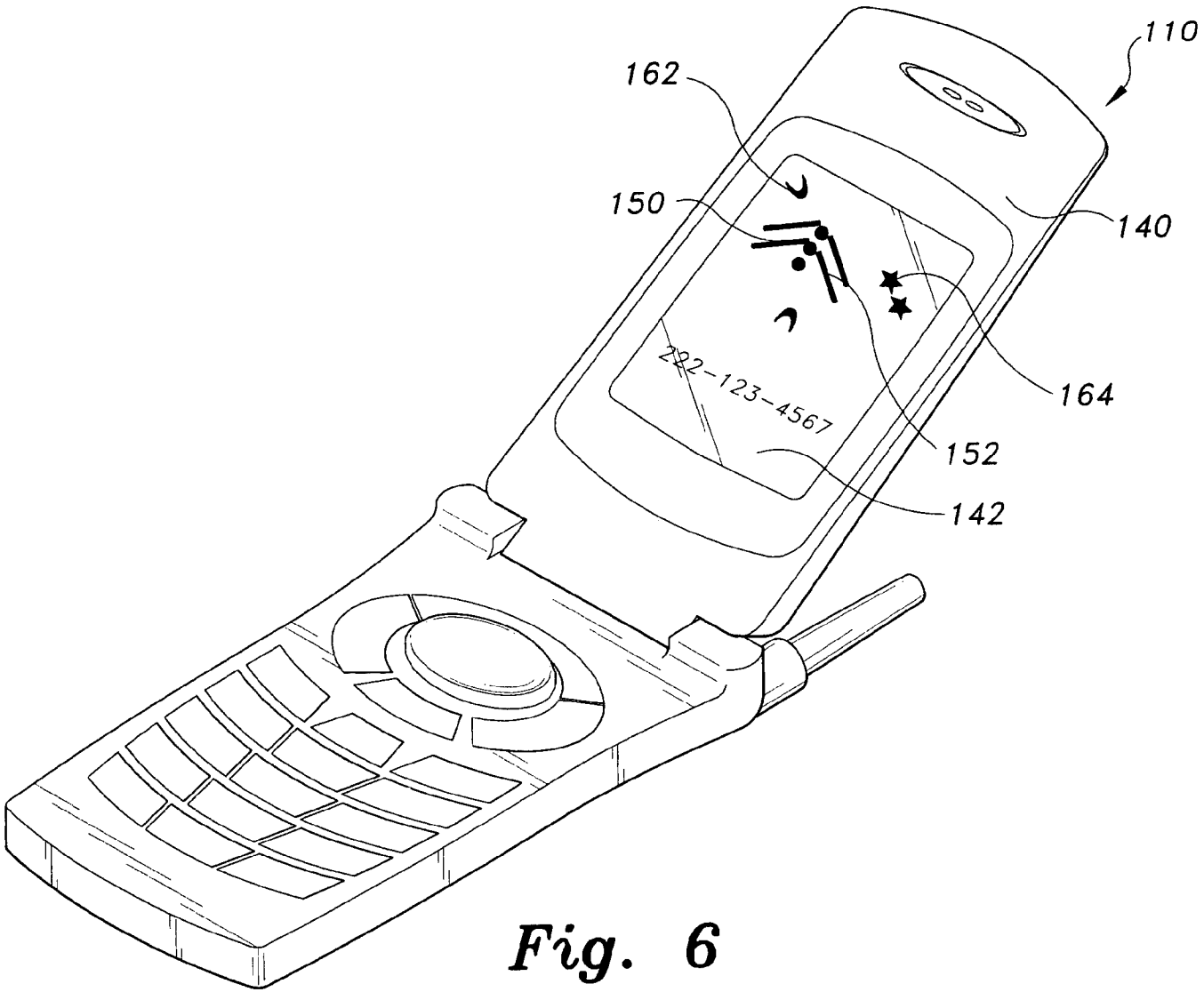
FIG. 6 is an environmental, perspective view of a device for displaying time according to the present invention, formed as a cellular telephone displaying time in hours and minutes.

Each minute display element 160 has at least an exhibiting state and a non-exhibiting state, and is for indication of at least 1 elapsed minute. As shown in FIGS. 5, 6, the amount of display elements of the minute display elements 160 being in the exhibiting state indicates an elapsed number of minutes in an hour. As examples, the number of minute display elements 160 may be 60 primary minute display elements 162 such that each primary minute display element 162 is for indication of 1 elapsed minute, 12 primary minute display elements 162 such that each primary minute display element 162 is for indication of 5 elapsed minutes, or 12 primary minute display elements 162 and 4 secondary minute display elements 164 such that each primary minute display element 162 is for indication of 5 elapsed minutes and each secondary minute display element 164 is for indication of 1 elapsed minute of a 4-minute period between each 5-minute interval.

Figure 12:
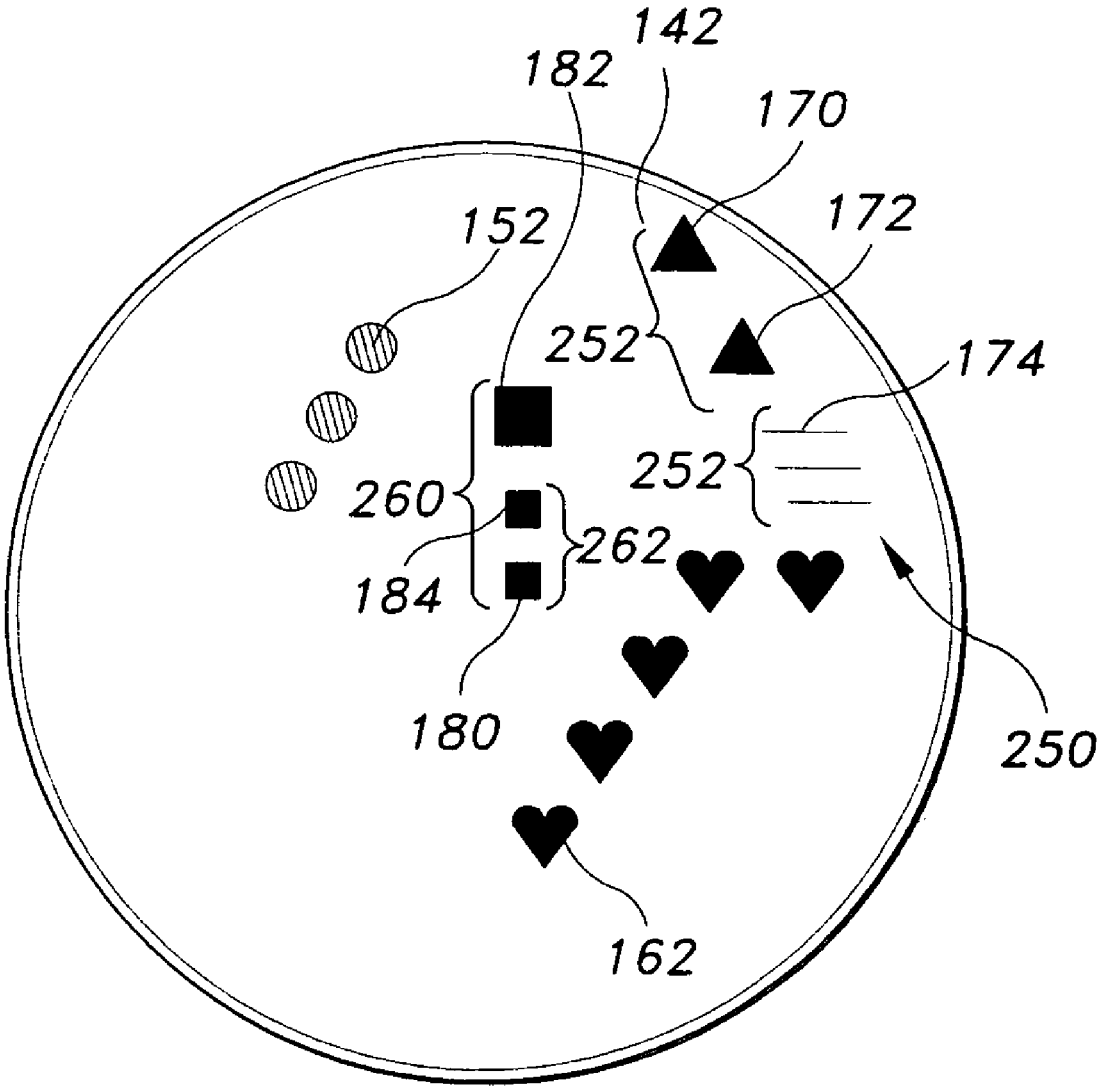
FIG. 12 is a top or front view of a device for displaying time according to the present invention, displaying time in the form of an hours group pattern, a minutes group pattern, a seconds group pattern and a days group pattern of another selectable display pattern.

Each second display element 170 has at least an exhibiting state and a non-exhibiting state, and is for indication of at least 1 elapsed second. As shown in FIG. 12, the amount of display elements of the second display elements 170 being in the exhibiting state indicates an elapsed number of seconds in a minute. As examples, the number of second display elements 170 may be 60 primary second display elements 172 such that each primary second display element 172 is for indication of 1 elapsed second, 12 primary second display elements 172 such that each primary second display element 172 is for indication of 5 elapsed seconds, or 12 primary second display elements 172 and 4 secondary second display elements 174 such that each primary second display element 172 is for indication of 5 elapsed seconds and each secondary second display element 174 is for indication of 1 elapsed second of a 4-second period between each 5-second interval.

Each day display element 180 has at least an exhibiting state and a non-exhibiting state, and is for indication of at least 1 elapsed day in a week. As shown in FIG. 12, the amount of display elements of the day display elements 180 being in the exhibiting state indicates an elapsed number of days in a week. As examples, the number of day display elements 180 may be 7 primary day display elements 182 such that each primary day display element 182 is for indication of 1 elapsed day, or 1 primary day display elements 182 and 4 secondary day display elements 184 such that each primary day display element 182 is for indication of 5 elapsed days and each secondary day display element 184 is for indication of 1 elapsed day of a 4-day period at the beginning of a week and, when in combination with the primary day display element 182 in the exhibiting state, of 1 elapsed day of the sixth and seventh days of the week.

Figure 2:
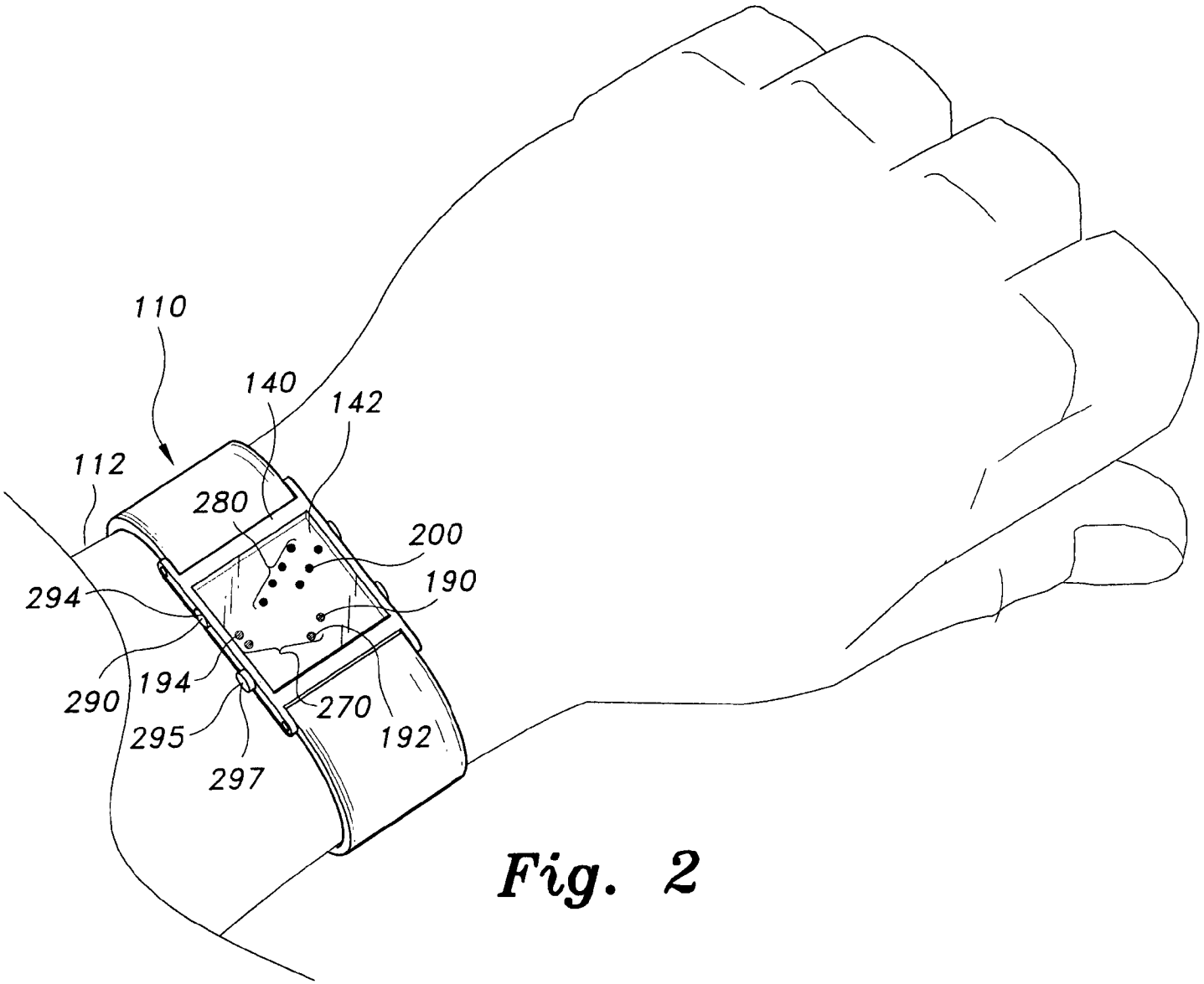
FIG. 2 is an environmental, perspective view of the device of FIG. 1 displaying the date and month.
Figure 13:
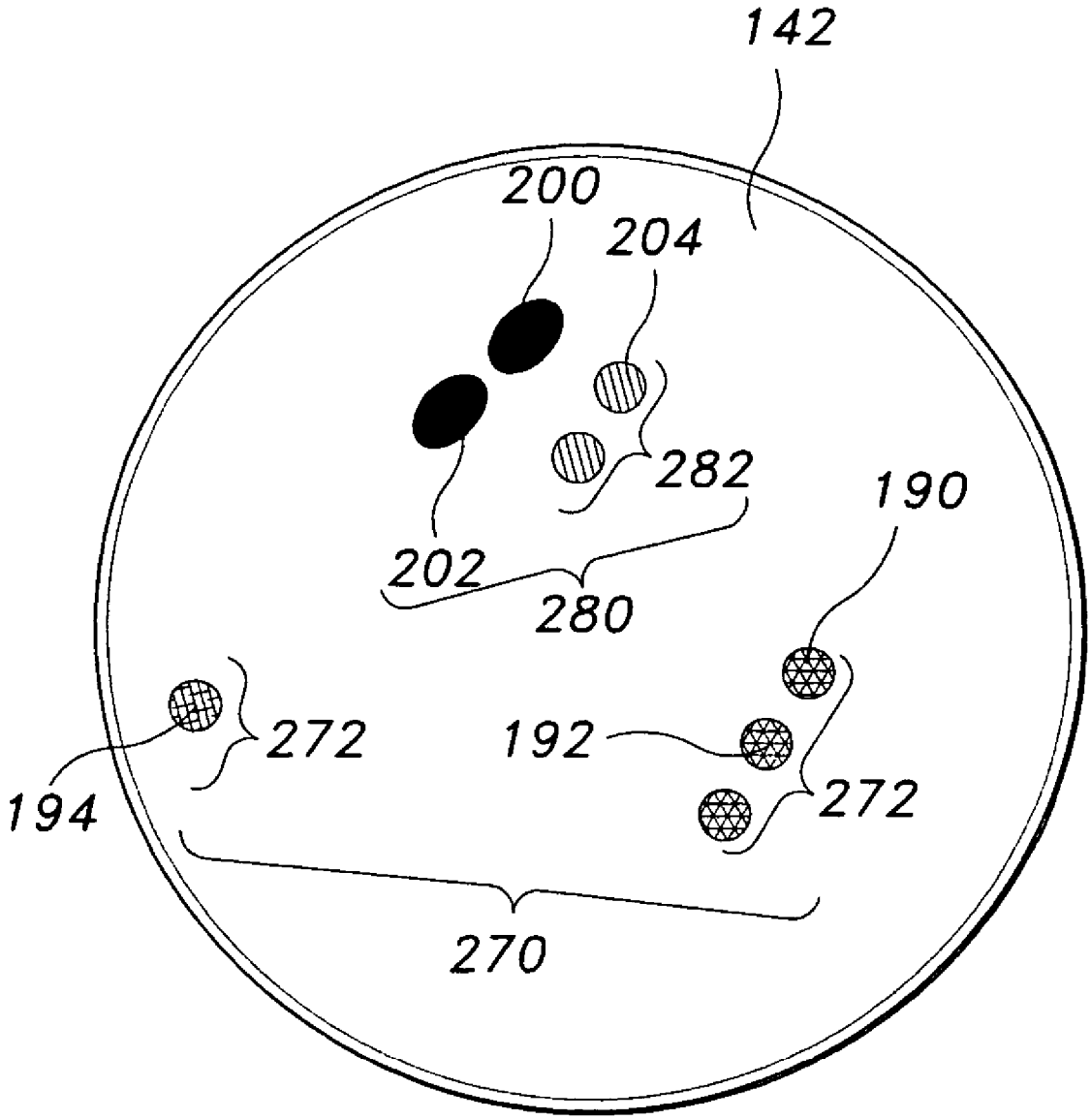
FIG. 13 is a top or front view of a device for displaying time according to the present invention, displaying time in the form of a date group pattern and a months group pattern of another selectable display pattern.

Each date display element 190 has at least an exhibiting state and a non-exhibiting state, and is for indication of at least 1 elapsed day in a month. As shown in FIGS. 2 and 13, the amount of display elements of the date display elements 190 being in the exhibiting state indicates an elapsed number of days in a month. As examples, the number of date display elements 190 may be 31 primary date display elements 192 such that each primary date display element 192 is for indication of 1 elapsed day in a month, or 6 primary date display elements 192 and 4 secondary date display elements 194 such that each primary date display element 192 is for indication of 5 elapsed days and each secondary date display element 194 is for indication of 1 elapsed day of a 4-day period between each 5-day interval and, when in combination with the 6 primary date display elements 192 in the exhibiting state, of 1 elapsed day of the thirty-first day of the month.

Each month display element 200 has at least an exhibiting state and a non-exhibiting state, and is for indication of at least 1 elapsed month. As shown in FIGS. 2 and 13, the amount of display elements of the month display elements 200 being in the exhibiting state indicates an elapsed number of months in a year.

As examples, the number of month display elements 200 may be 12 primary month display elements 202 such that each primary month display element 202 is for indication of 1 elapsed month in a year, or 2 primary month display elements 202 and 4 secondary month display elements 204 such that each primary month display element 202 is for indication of 5 elapsed months and each secondary month display element 204 is for indication of 1 elapsed month of a 4-month period between each 5-month interval and, when in combination with the 2 primary month display elements 202 in the exhibiting state, of 1 elapsed month of the eleventh and twelfth months of the year.

Figure 4:
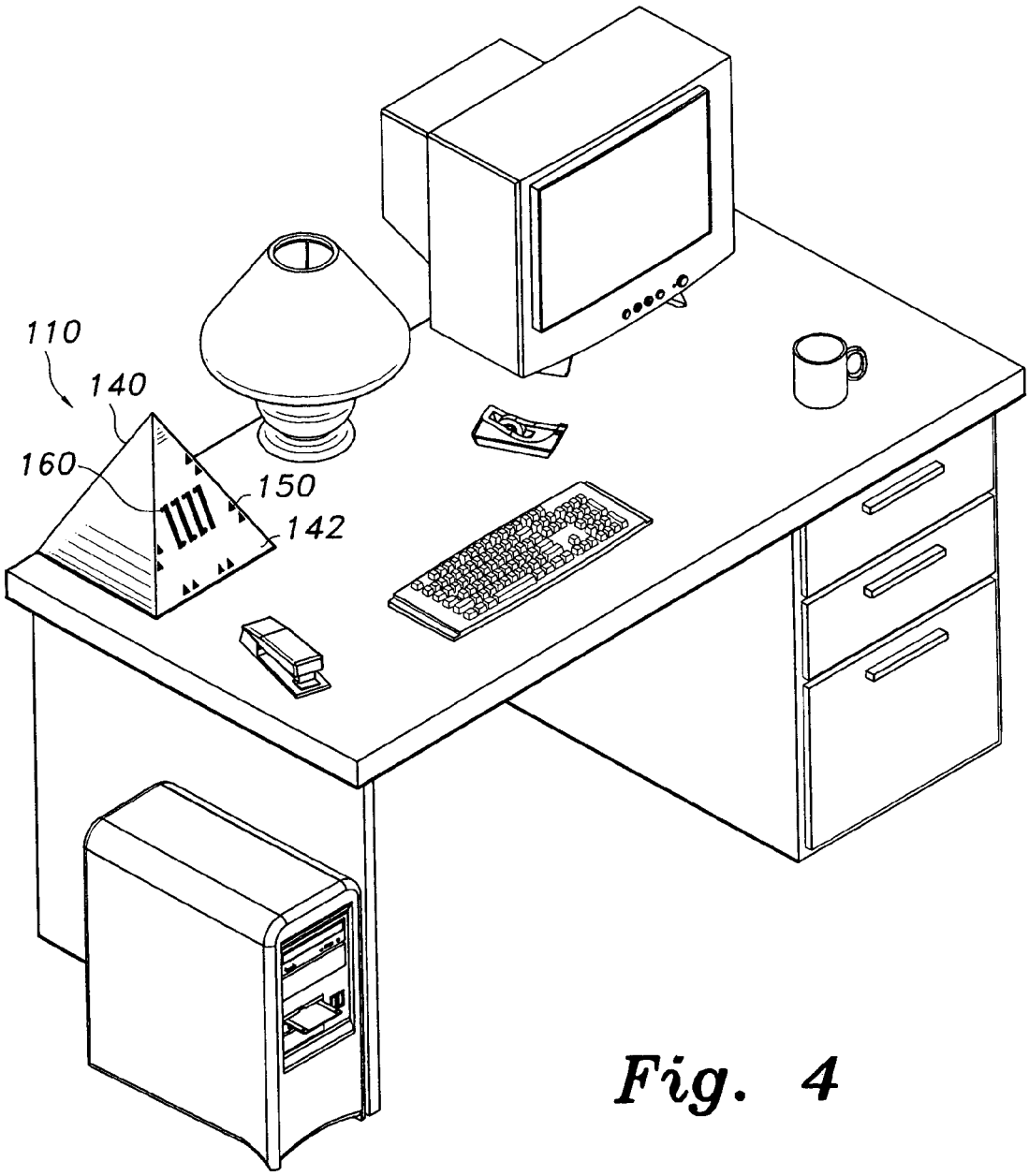
FIG. 4 is an environmental, perspective view of a device for displaying time according to the present invention, formed as a desk clock displaying time in hours and minutes.
Figure 7:
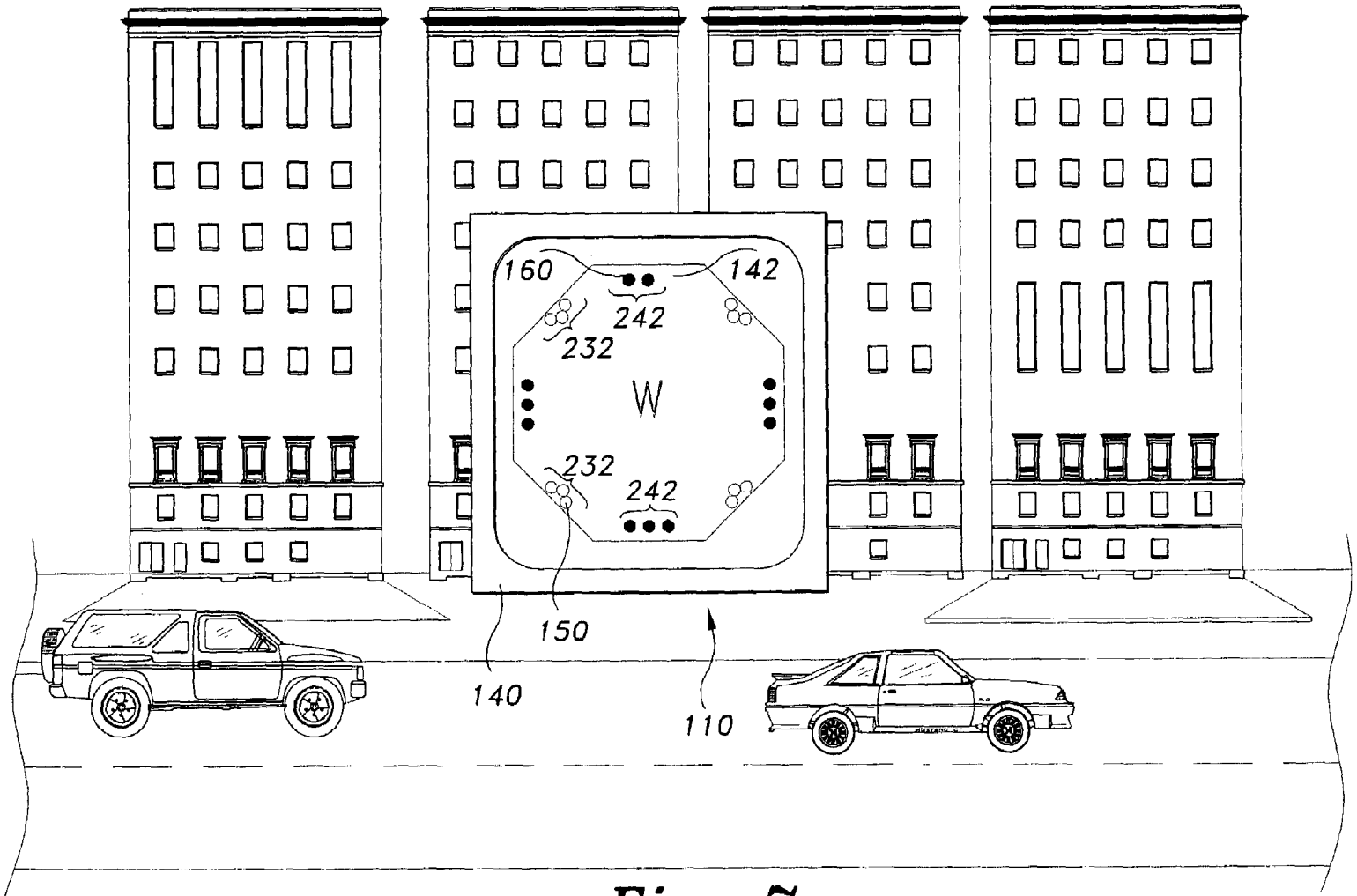
FIG. 7 is an environmental, perspective view of a device for displaying time according to the present invention, formed as a billboard type of clock displaying time in hours and minutes.
Figure 11:
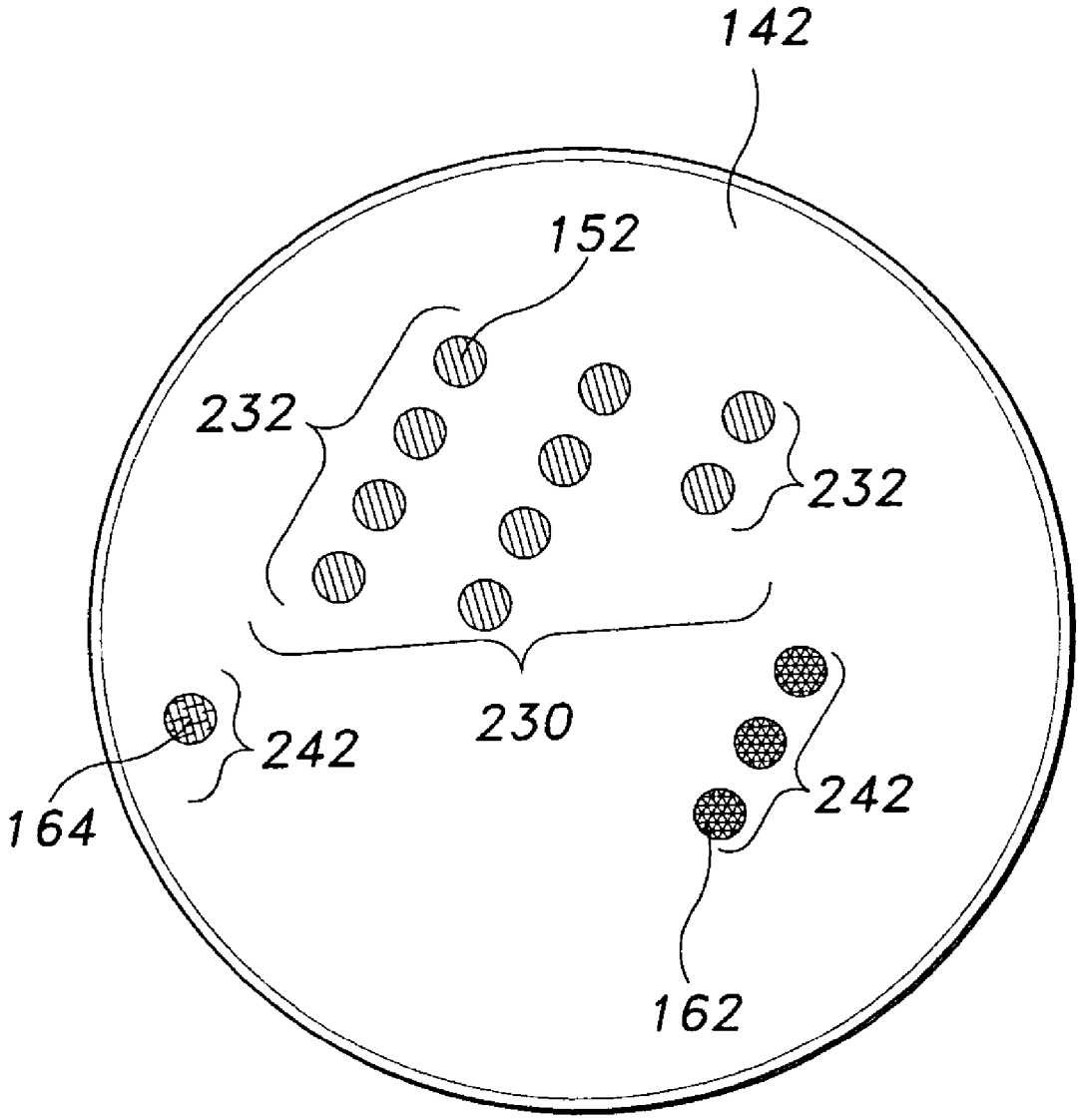
FIG. 11 is a top or front view of a device for displaying time according to the present invention, displaying time in the form of an hours group pattern and a minutes group pattern of another selectable display pattern.

As examples of the representation of time by the exhibition of the plurality of display elements in the exhibiting state, FIG. 1 shows that the time is 8 hours and 30 minutes. FIG. 2 shows that the date is July 12th. FIG. 4 shows that the time is 10 hours and 55 minutes. FIG. 5 shows that the time is 11 hours and 5 minutes. FIG. 6 shows that the time is 7 hours and 12 minutes. FIGS. 7 and 8 show that the time is 12 hours and 55 minutes. FIG. 9 shows that the time is 11 hours and 10 minutes A.M. FIG. 10 shows that the time is 11 hours and 10 minutes P.M. FIG. 11 shows that the time is 10 hours and 16 minutes. FIG. 12 shows that the time is 3 hours, 25 minutes and 13 seconds, and that the day of the week is the 7th day or Sunday. FIG. 13 shows that the date is December 16th. FIG. 15 shows that the time is 8 hours and 15 minutes.

As noted above, FIG. 9 illustrates the time (11:10 in this example) in an A.M. mode and FIG. 10 illustrates the time in a P.M. mode. As shown in FIG. 9, the display elements form an upwardly-pointing arrow, denoting A.M., and in FIG. 10, the display elements form a downwardly-pointing arrow, denoting P.M. It should be recognized that these are examples of user-selectable orientations and positions for the display and representation of A.M. or P.M., and that the user may select any suitable orientation, direction or position of display elements to denote A.M. or P.M. time. For example, display elements which are positioned on one half of the display screen may represent A.M., whereas display elements positioned on the other half of the display screen may denote P.M.

As shown in FIGS. 14 and 15, the display elements controller 210 is in communication with a time mechanism 220, the storage device 120, and the interface 130, and may be contained within the housing 140. Also, the controller 210 is in operable communication with the plurality of display elements 150,160,170,180,190,200 such that the controller 210 is adapted for switching each of the plurality of display elements 150,160,170,180,190,200 at least between the exhibiting state and non-exhibiting state of the respective display element 150,160,170,180,190,200. Further, the controller 210 is adapted for receiving time signals from the time mechanism 220 and, in response to the time signals, outputs display control signals to the plurality of display elements 150,160,170,180,190,200 such that an hours group pattern 230, a minutes group pattern 240, a seconds group pattern 250, a days group pattern 260, a date group pattern 270, and/or a months group pattern 280, of the selected selectable display pattern are exhibited proximate to the display area 142. FIG. 15 shows the interior 144 and exterior 146 of a preferred embodiment of the device 110 in the form of a watch 110*a*.

The controller 210 may be any known microprocessor integrated circuit including a process unit and memory. The memory may include random access memory (RAM), read only memory (ROM), erasable programmable ROM (EPROM) and a data storage memory. In a preferred embodiment, the controller 210 comprises a processor and internal memory wherein the software to control the controller 210 is stored on the internal memory. Also, the controller 210 may be an LCD controller, an LED controller, a shutters controller, or any known standard means of addressing or controlling the plurality of display elements, such as through software or hardware programming.

Each of the group patterns 230,240,250,260,270,280 of the selected selectable display pattern is of discrete and discernable contrast relative to the display area 142, and is visually distinguishable from one another. Also, as shown in FIGS. 7-13, 15 and 16, each of the group patterns 230,240,250,260,270,280 includes a plurality of subgroup patterns 232,242,252,262,272,282 such that each subgroup pattern 232,242,252,262,272,282 is able to be initiated by any display element 150,160,170,180,190,200 within that particular subgroup pattern 232,242,252,262,272,282. Further, the chronological sequence of exhibition proximate to the display area 142 among the subgroup patterns 232,242,252,262,272,282 of a group pattern 230,240,250,260,270,280 is able to be initiated by any display element 150,160,170,180,190,200 within any one of the subgroup patterns 232,242,252,262,272,282 of that group pattern 230,240,250,260,270,280. The groupings and subgroupings of the display elements 150,160,170,180,190,200 are displayed in repeatable, recognizable patterns in relation to time. To facilitate rapid comprehension of the selected selectable display pattern by a viewer or the operator, each subgroup pattern 232,242,252,262,272,282 of each group pattern 230, 240, 250, 260, 270, 280 may be exhibited by 2 display elements to 6 display elements.

The group patterns 230,240,250,260,270,280 may be exhibited proximate to the display area 142 in a variety of different ways relative to the operator's 112 or manufacturer's tastes or preferences. As examples, the group patterns 230, 240, 250, 260, 270, 280 may be exhibited of different colors, different size dots, lines or shapes, different shaped dots, lines or shapes, and/or different spacing between dots, lines or shapes. The groupings of dots, lines, and/or shapes can be customizable into various groupings or patterns. The dots, lines and shapes can take any form, such as, circular, triangular, rectangular, square, non-uniform shape, straight, curved, dashed, etc., size, spacing, etc., as long as the dots, lines and shapes are discrete and discernable relative to the display area 142. The groupings of dots, lines and/or shapes can be changeable periodically, such as, daily, from A.M. to P.M., weekly, monthly, etc., or aperiodically, via the manufacturer or the individual owner through a software, hardware, a mechanical interface, or any other means or method known in the art, randomly, automatically, etc. The different ways in which the group patterns 230,240,250,260,270,280 may be exhibited may help to enhance the ability of the viewer or operator 112 to quickly and readily recognize and interpret time from the different group patterns 230,240,250, 260,270,280. This may also help to enhance the aesthetic qualities of the selectable display patterns. Also, a couple or several of the group patterns 230,240,250,260,270,280 may be programmed to combine and form a single display pattern.

As examples, a source of the exhibition of the plurality of display elements 150,160,170,180,190,200 may be emitted light, reflected light, such as light reflected off of shutters, fluorescent light, or any illumination means or method.

For simplicity and/or manufacturing preferences, the storage device 120, interface 130, plurality of display elements 150,160,170,180,190,200 and controller 210 may be integrated into fewer devices, such as being manufactured as a single operating device.

In addition, as shown in FIGS. 1 and 2, the interface 130 may include a pattern toggle member 290 that is able to be placed by the operator 112 in either of a first position 292 and a second position 294. When the pattern toggle member 290 is in the first position 292, a first display of at least one of the group patterns, such as the hours group pattern 230 and minutes group pattern 240, is displayed or shown. When the pattern toggle member 290 is in the second position 294, a second display of at least one of the other group patterns, such as the date group pattern 270 and months group pattern 280, is displayed or shown such that the first display and the second display are visually distinguishable from one another.

Alternatively, the toggle member 290 may be a momentary switch which successively scrolls through the toggle states. The toggle states may include a third toggle state, shown in FIG. 2A, in which both the date and time are displayed.

Figure 2A:
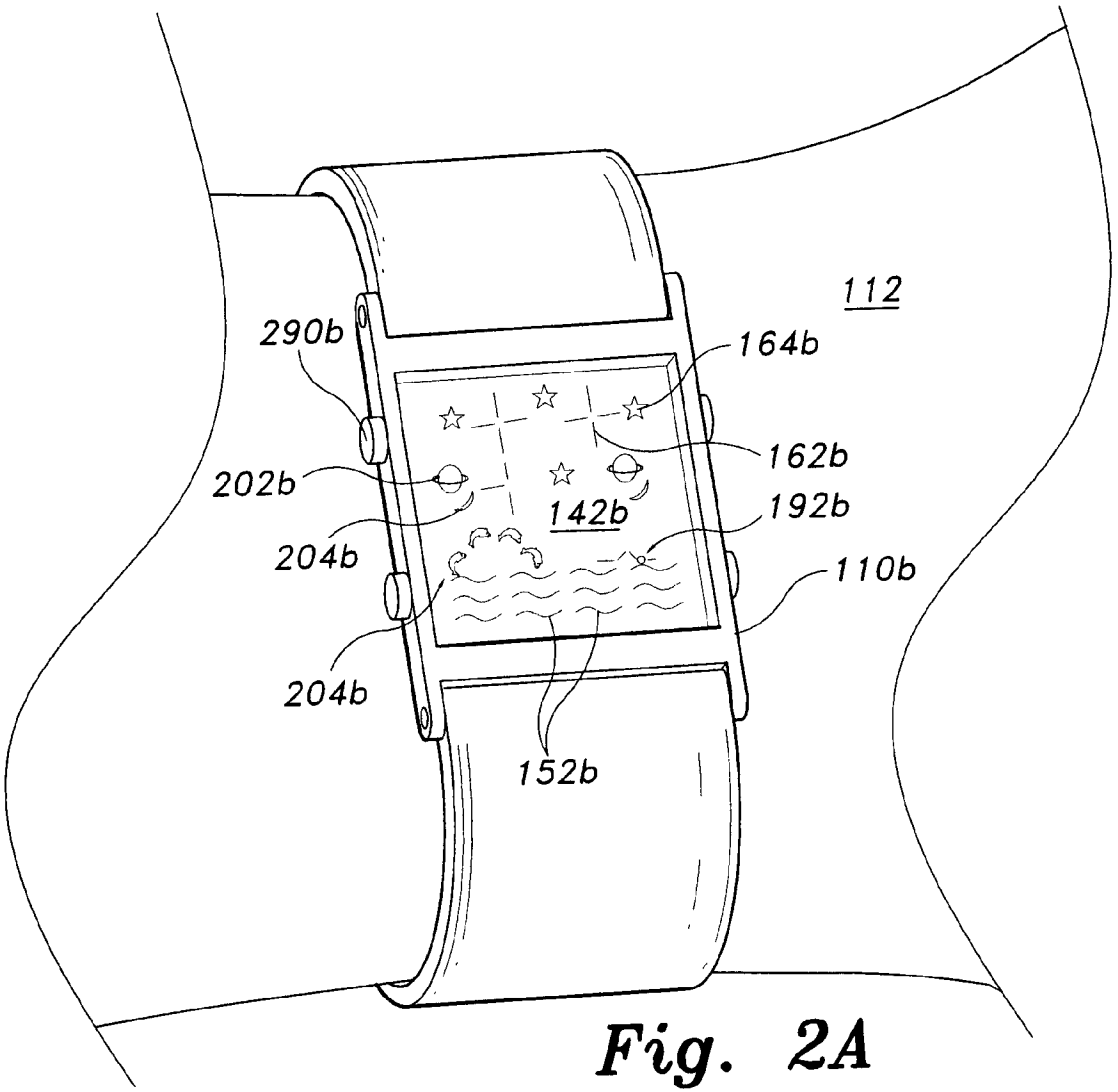
FIG. 2A is a fragmented, environmental perspective view of a watch similar to the device of FIG. 1, expanded to show a toggle state in which the display area shows both the date and time.

In FIG. 2A, the device is configured as a watch 1110*b* with display area 142*b*. Toggle switch 290*b* is a momentary switch which causes the display to toggle between display states each time the switch 290*b* is depressed, the toggle states including a first state displaying only the time, a second state displaying only the date, and a third state showing both the date and the time. FIG. 2A is shown expanded to show details of the display. In this Figure, the date shown is December 29. The display elements corresponding to the month include the primary month symbol 202*b*, depicted as the planet Saturn, each occurrence of the Saturn symbol 202*b* representing five elapsed months, and the secondary month symbol 204*b*, depicted as one of Saturn's moons and corresponding to a single elapsed month. Since two Saturn symbols 202*b* and two moons 204*b* appear in the display, the corresponding month is the twelfth month, December.

In FIG. 2A, the display elements corresponding to the date include the primary date symbol 192*b*, depicted as the swimming man stick figure, each element of the stick figure 192*b* corresponding to five elapsed days, and the secondary date symbol 194*b*, depicted as flying fish, each flying fish corresponding to one elapsed day. Since the primary date symbol 192*b* includes five stick elements (the head, three arm elements, and one leg element) and four flying fish, the date shown in FIG. 2A is the 29th of the month.

The time displayed in FIG. 2A is 12:59. The time elements include the primary hour display element 152*b*, depicted as a wave or ripple in a body of water, each ripple 152*b* corresponding to one elapsed hour; the primary minutes display element 162*b*, depicted as a large star in the Figure with each light ray or stick emanating from the center of the star representing five minutes; and the secondary minutes display element 164*b*, depicted as a small star in the Figure, each small star 164*b* representing a single elapsed minute. Since there are twelve ripples 152*b*, three large stars 162*b* exhibiting eleven light rays, and four small stars 164*b* shown on the display 142*b* in FIG. 2A, the time represented is twelve hours and fifty-nine minutes.

As shown in FIG. 2A, the display elements may cooperate to form a graphical image, such as the man swimming under the heavens accompanied by flying fish. FIG. 2A also illustrates that the display elements used to show the date are not required to be exhibited adjacent to each other, nor are the display elements used to show the time required to be grouped together. It is sufficient that the user understand the significance assigned to each symbol.

FIG. 2A also illustrates that the symbols designating the hours and minutes are not required to be shown in a conventional clockwise rotation. Again, it is sufficient that the user understand the significance assigned to each symbol. Although the symbols shown in FIG. 2A are differentiated on the basis of shape, it will be obvious to those skilled in the art that the display elements may alternatively be differentiated on the basis of color, light intensity, or any other visual characteristic.

Figure 3:
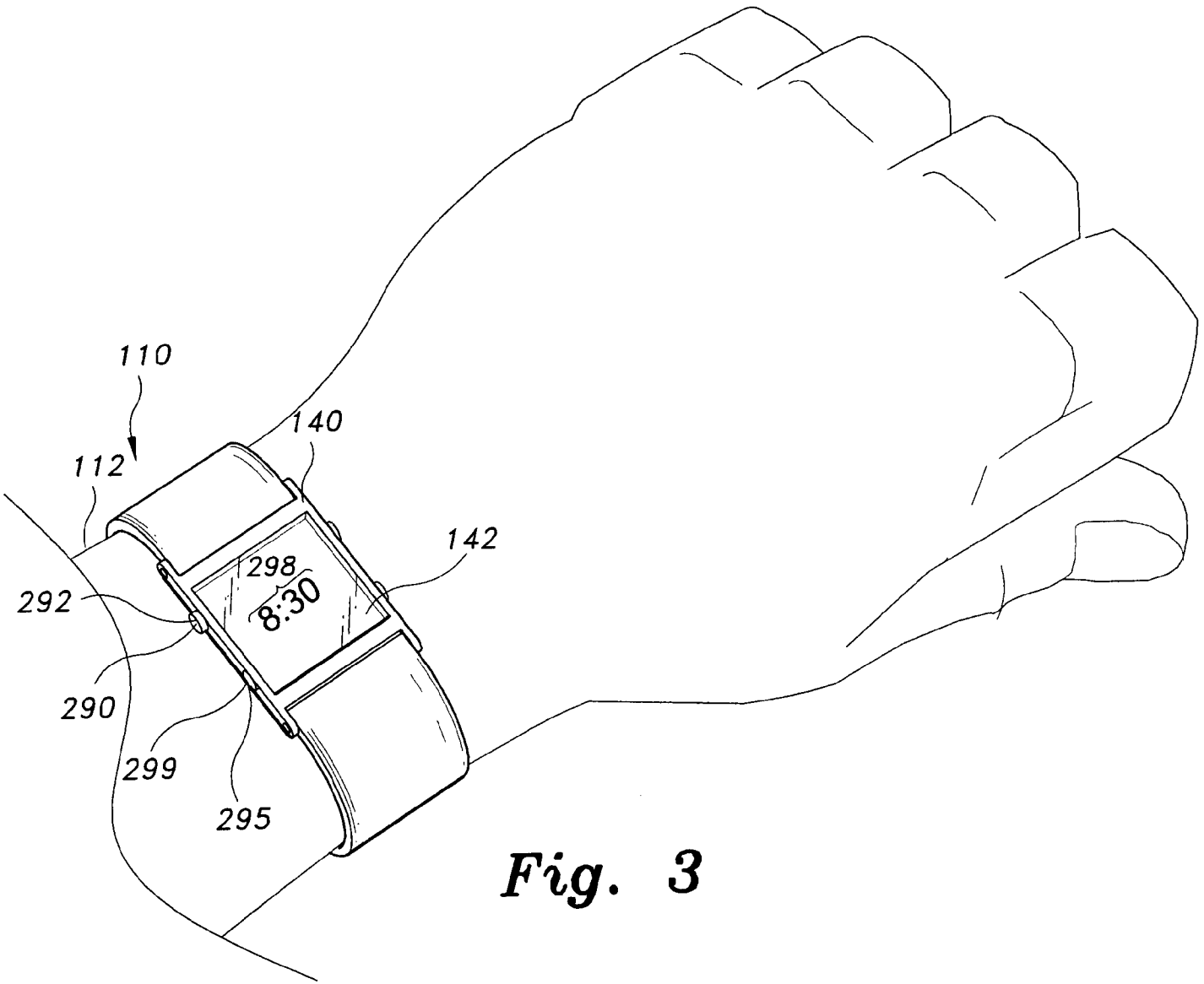
FIG. 3 is an environmental, perspective view of the device of FIG. 1 displaying time in a numerical or digital pattern.

Furthermore, as shown in FIGS. 1 and 3, the interface 130 may be, or include, a time display toggle member 295 that is able to be placed by the operator 112 in either of a first position 297 and a second position 299. When the time display toggle member 295 is in the first position 297, a first display of at least one of the group patterns, such as the hours group pattern 230 and minutes group pattern 240, is displayed or shown. When the time display toggle member 295 is in the second position 299, a second display of a numerical time pattern 298 is displayed or shown.

Figure 16:
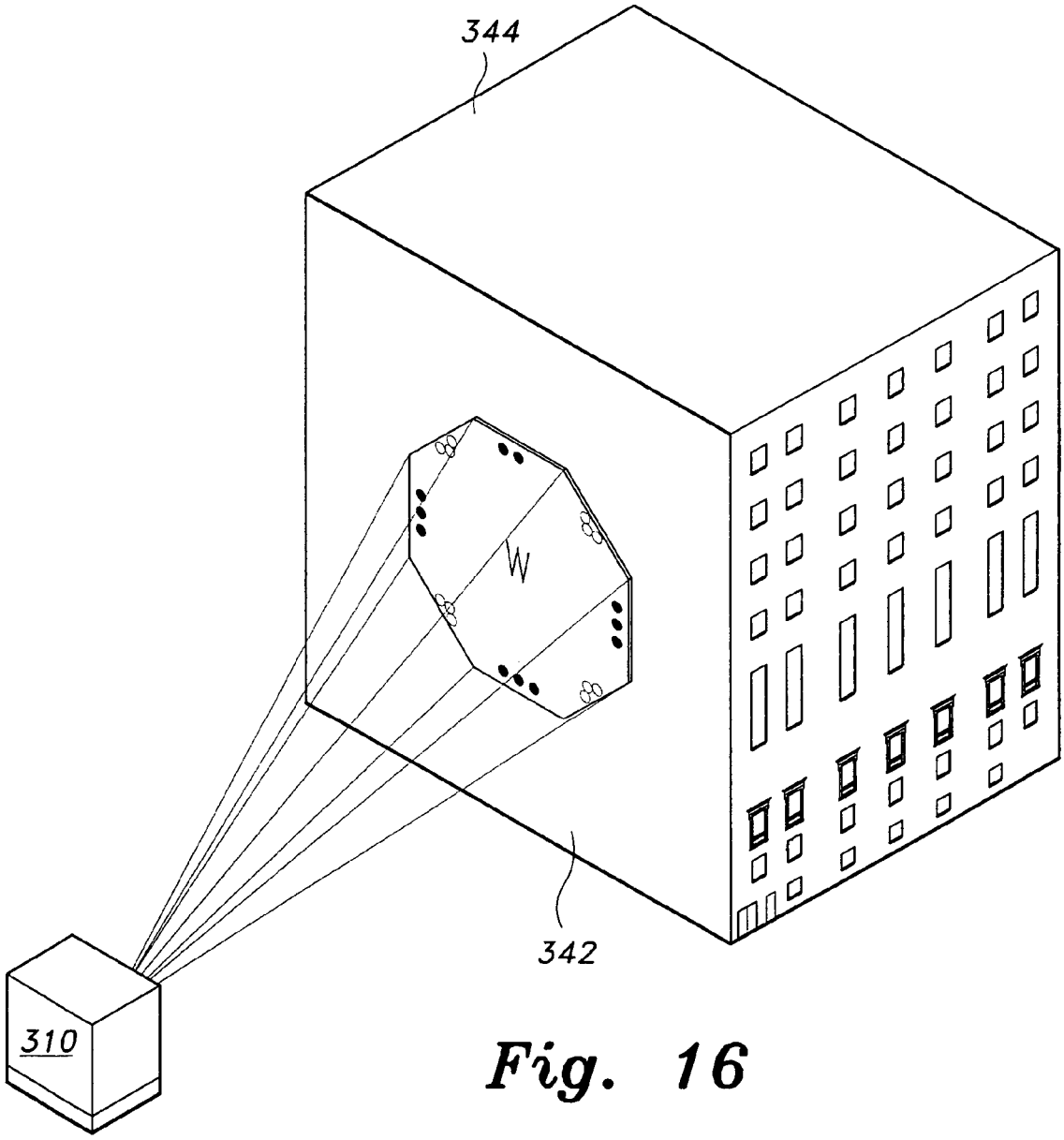
FIG. 16 is an environmental, perspective view of another embodiment of the device for displaying time according to the present invention, as a projection device displaying time in the form of an hours group pattern and a minutes group pattern of a selectable display pattern.

In a second embodiment of the present invention, shown in FIG. 16, the device 310 includes the storage device 120, the interface 130, the plurality of display elements 150,160,170, 180,190,200, and the display elements controller 210. The device 310 of the second embodiment differs from the device 110 of the first embodiment in that the device 310 of the second embodiment does not include the housing 140. An example of the device 310 is a projection device that is adapted for projecting an image of the selected selectable display pattern on a display area 342 of a structure, such as a blank billboard, a screen, a wall, or a side of a building 344.

Further, the device 110,310 of the present invention is flexible in that it allows the operator 112 and/or manufacturer to select another selectable display pattern when a different display pattern to be displayed is desired. This may be done through a software, hardware, a mechanical interface, or any other means or method known in the art.

In addition, mixing of traditional representations of time and the newly proposed representation of time is possible. Also, simultaneous representation of traditional and the newly proposed representations of time is possible.

Figure 17:
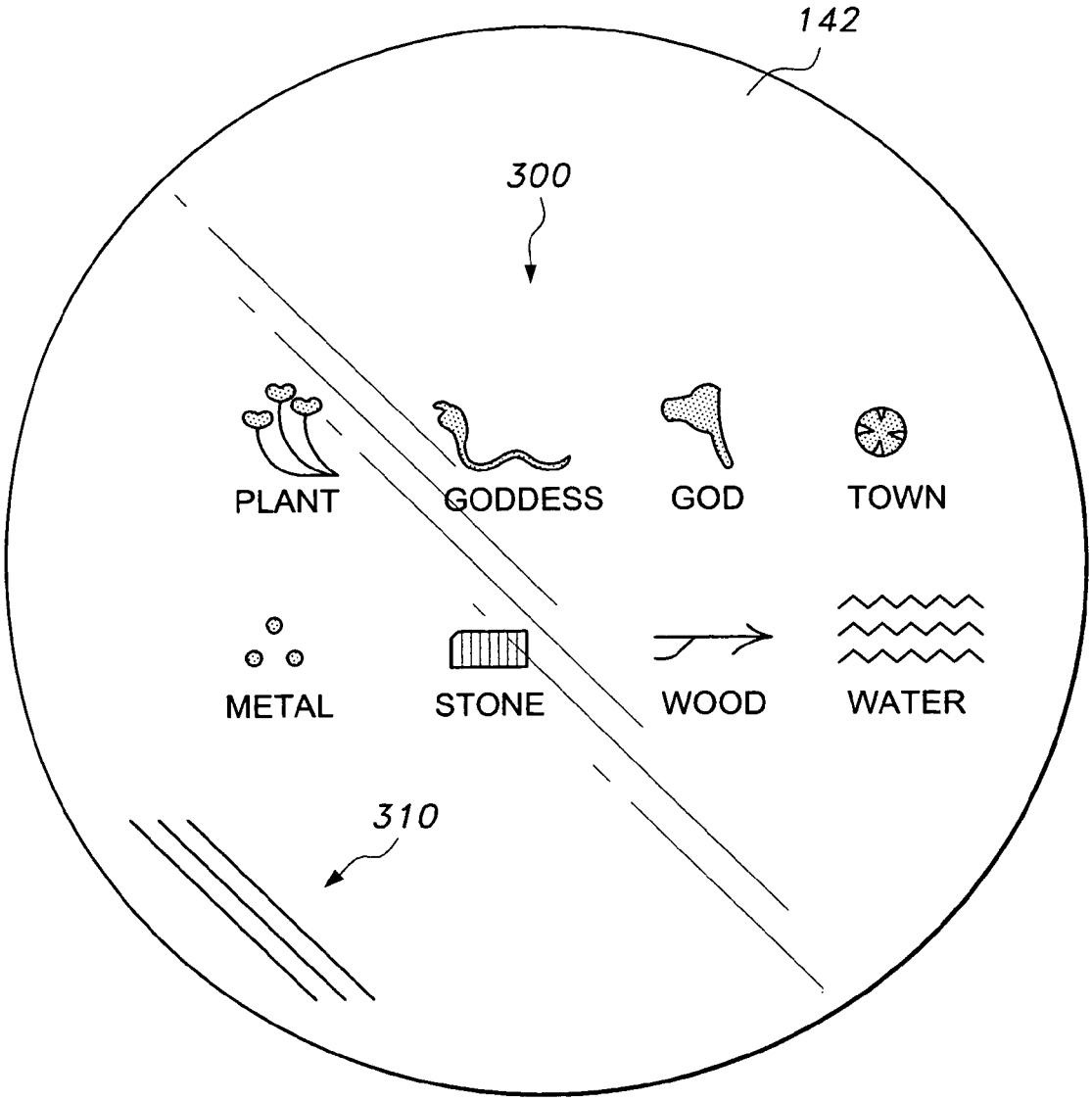
FIG. 17 is a top or front view of a device for displaying time according to the present invention, displaying time in the form of an hours group pattern and a minutes group pattern of another selectable display pattern.

In the alternative embodiment shown in FIG. 17, display elements 300 and 310 are displayed on display area 142. Rather than the simplified graphical representations used in the embodiments of FIGS. 8-13, display elements 300 are graphical icons, here shown as hieroglyphics. Each graphical icon may also include a printed word, describing the graphical representation of the icon, as shown. Display elements 310, forming a second set of display elements, are in the form of line segments. It should be understood that the user may select any graphical representation for display elements 300 and 310. A wide variety of different graphical representations may be stored in storage device 120 and may be selected by the user for display on display area 142.

In FIG. 17, eight icons are included in display element group 300. Group 300 represents the time in hours. Similarly, three line segments are included in group 310. Each line segment represents five minutes, thus the time displayed in display 142 is 8:15. It should be understood that the user may choose a one-to-one correspondence for the minute display; i.e., the user may select a graphical representation for the minutes in which, in the example of FIG. 17, fifteen line segments or other icons are selected to display the time. Further, though it is conventional to demarcate time in five minute intervals, display elements representing other intervals, such as 2½ minutes, for example, may be utilized. For example, conventional clocks typically include demarcations of some sort at 5 minutes, 10 minutes, 15 minutes, etc., printed on the face of the clock. In a time device according to the present embodiment of the instant invention, minutes could be demarcated at 2½ minutes, 7½ minutes, 12½ minutes, 17½ minutes, etc., with each demarcation occurring at ±2½ minutes from one of the conventional 5 minute marks.

In the example shown in FIG. 17, with reference to the above system of minute demarcation, the third line segment, which represents a 15 minute time interval, would be activated at 12½ minutes after 8:00, and the next line segment activated (the fourth, not shown in the Figure), which would represent a 20 minute time interval, would be activated at 17½ minutes after 8:00. Thus, the accuracy of the time keeping device is 2½ minutes, rather than the standard 5 minute accuracy associated with conventional clocks and watches.

Figure 18:
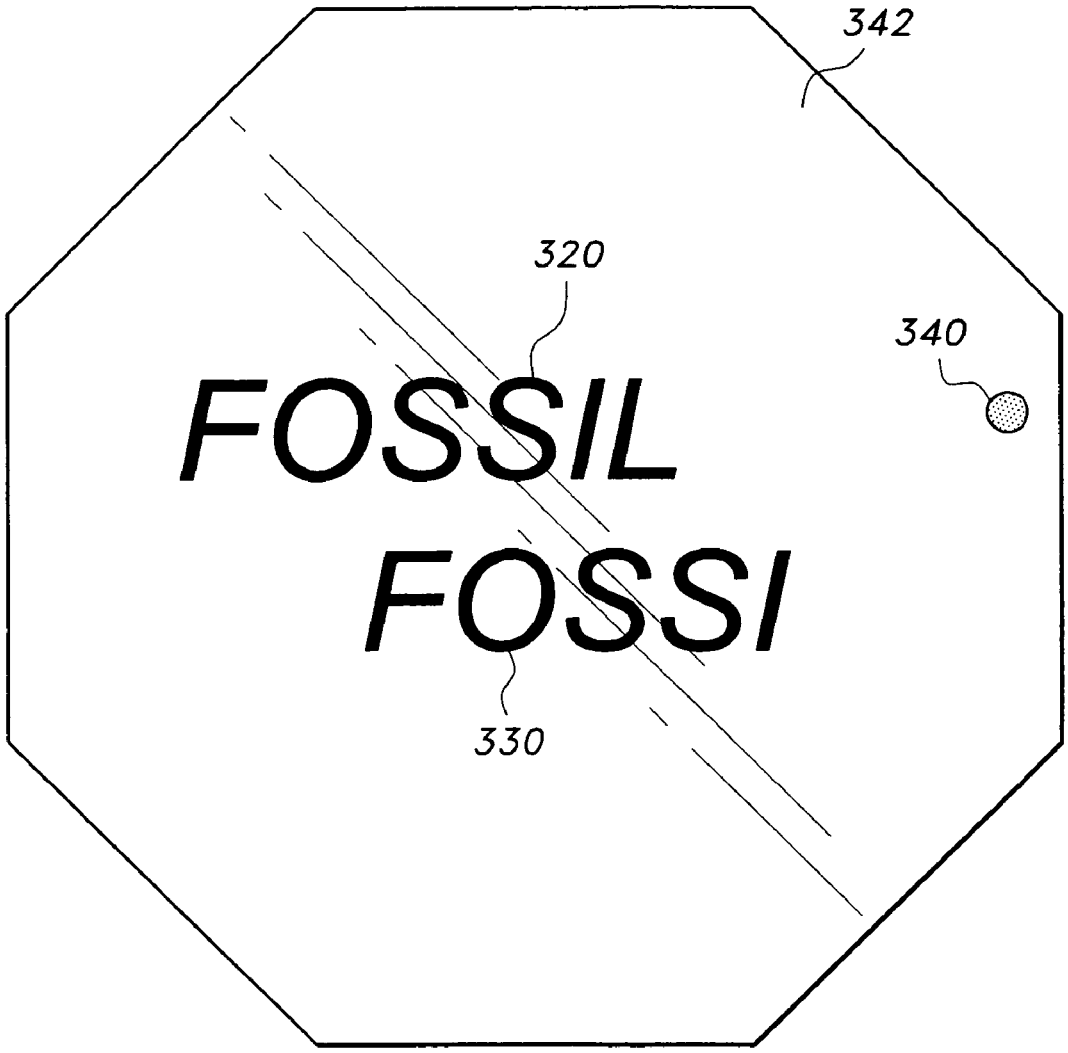
FIG. 18 is a top or front view of a device for displaying time according to the present invention, displaying time in the form of an hours group pattern and a minutes group pattern of another selectable display pattern.

In the embodiment of FIG. 18, the display area 342 is shown as having a substantially octagonal contour. It should be understood that the display area may have any suitable contour, depending upon the needs and desires of the user. Similarly, the display area 342 may be used in combination with a timepiece having any suitable size, shape or contour. In this embodiment, display element groups 320, 330 represent the time in hours. Groups 320, 330 are in the form of words, with each letter of each word representing one hour. Though shown as being the same word, it should be understood that groups 320 and 330 do not need to be identical; they could differ by color or pattern or could show two different words.

In the embodiment of FIG. 18, the minute portion of the time display is represented by display element group 340, shown here as a dot. As described above, the graphical representations selected for the display elements may be selected by the user. In the example shown, the total number of letters displayed by groups 320 and 330 is eleven. Thus, the time in hours is eleven. Similarly, one dot is displayed in group 340, with one dot representing five minutes. Thus, the time displayed is 11:05. As noted above, the display elements may be oriented so as to give an indication of AM time or PM time (as best shown in FIGS. 9 and 10). Though shown as representing five minutes in this example, it should be understood that each dot may represent a user-selectable time interval, such as one minute, for example.

Figure 19:
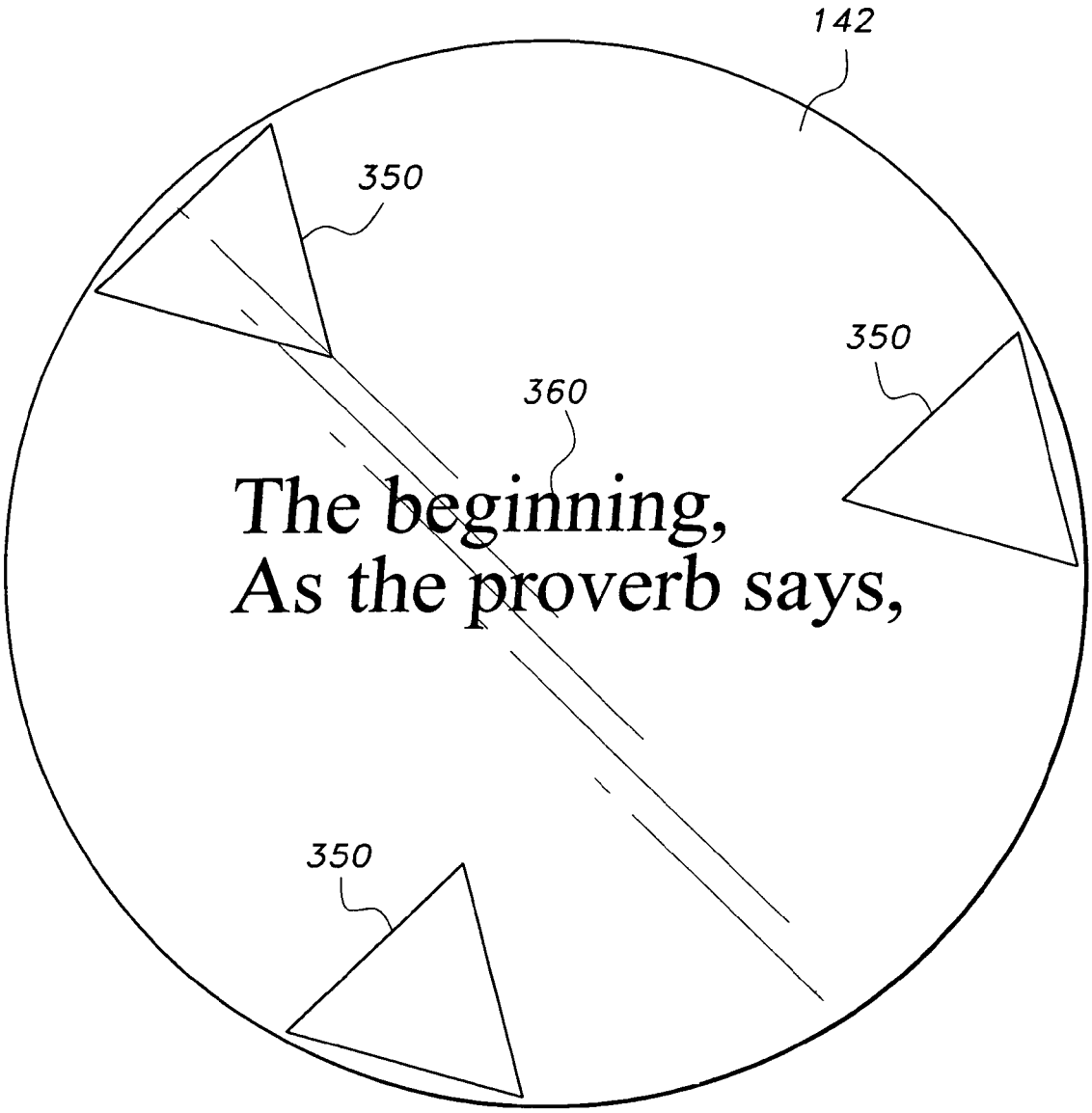
FIG. 19 is a top or front view of a device for displaying time according to the present invention, displaying time in the form of an hours group pattern and a minutes group pattern of another selectable display pattern.

In the embodiment illustrated in FIG. 19, the time in hours is represented by simple geometric shapes, shown here as triangles. Display element group 350 may, as described above, have any desired graphical representation. Display element group 360 uses words, forming part of a quotation, to display the minute portion of the time. In this example, there are three triangles shown in group 350, and there are six words shown in group 360, with each word representing five minutes. Thus, the time displayed in display area 142 is 3:30. It should be noted that the quotation used may be selected for educational or inspirational purposes, and a different quotation may appear on a periodic bases; i.e., each day, each week, each month, etc. The selection of graphical representation, including the words, phrases and quotations used, are dependent upon the needs and desires of the user. Further, the period of display of the words, phrases and quotations is dependent upon the needs and desires of the user.

Figure 20:
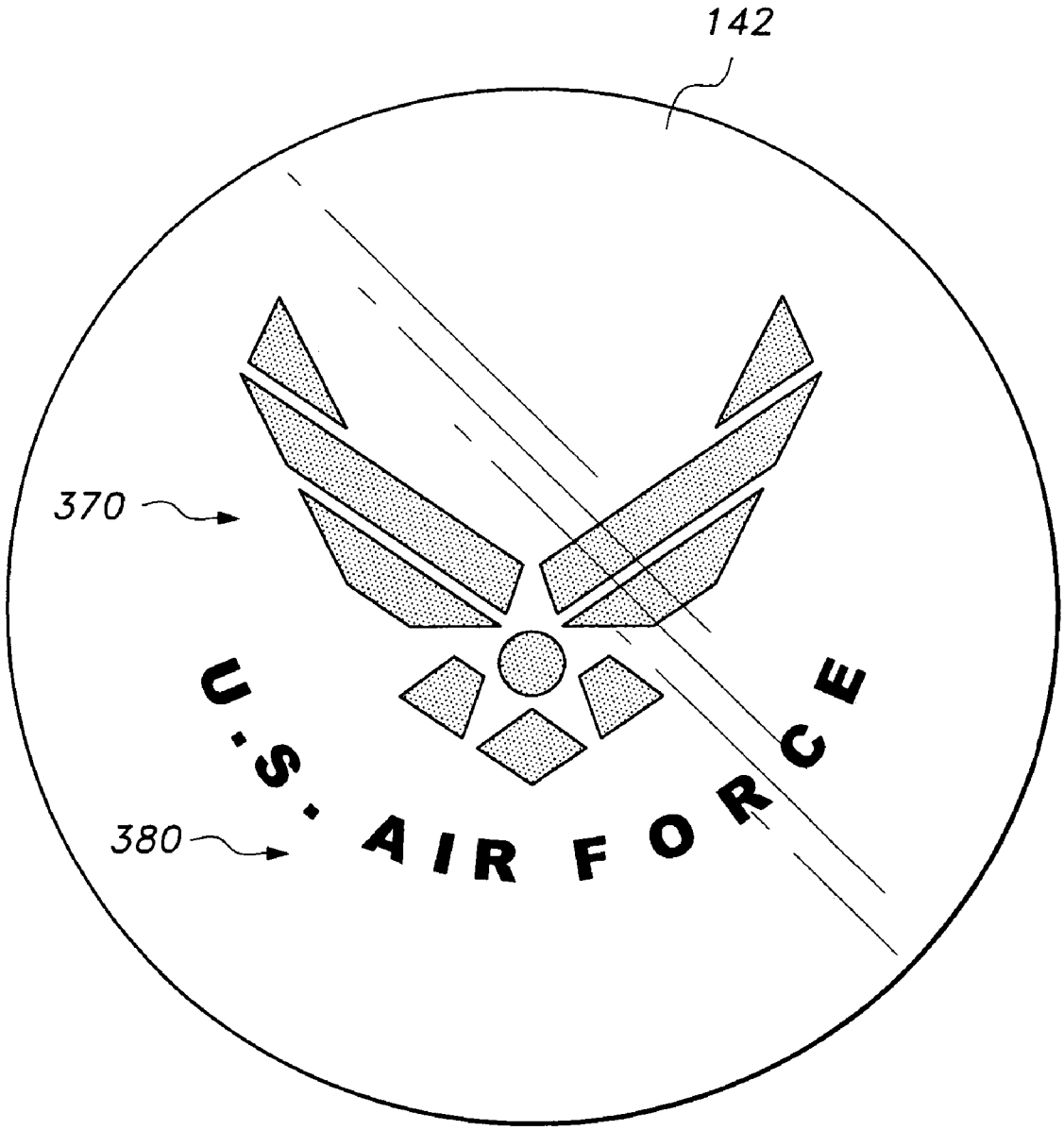
FIG. 20 is a top or front view of a device for displaying time according to the present invention, displaying time in the form of an hours group pattern and a minutes group pattern of another selectable display pattern.

In the embodiment of FIG. 20, letters and a related symbol are utilized to display the time in display area 142. In this example, the display element group 380, which represents hours, spells out "U.S. Air Force", with each letter representing one hour. Display element group 370 forms the Air Force logo, with each portion of the logo representing a five minute interval. The user may select any such pairing of letters and words with a related logo or symbol, or the user may choose graphical representations which mix words and letters with unrelated symbols or patterns. In this example, the total number of characters displayed by group 380 is twelve. The number of separated portions or segments in the logo of group 370 is ten, thus the time displayed is. 12:50. As described above, the user may further selectively alter the coloration, texture, font or other characteristics of the letters and symbols displayed. Further, additional letters, symbols, icons or other suitable graphical representations may be utilized on the display face to denote time intervals. For example, in the example shown, the Air Force logo is complete at 12:50, thus, in order to display 12:55, one more element must be utilized. A boundary or border positioned about the logo may be utilized, or the user may select any suitable additional element.

Figure 21:
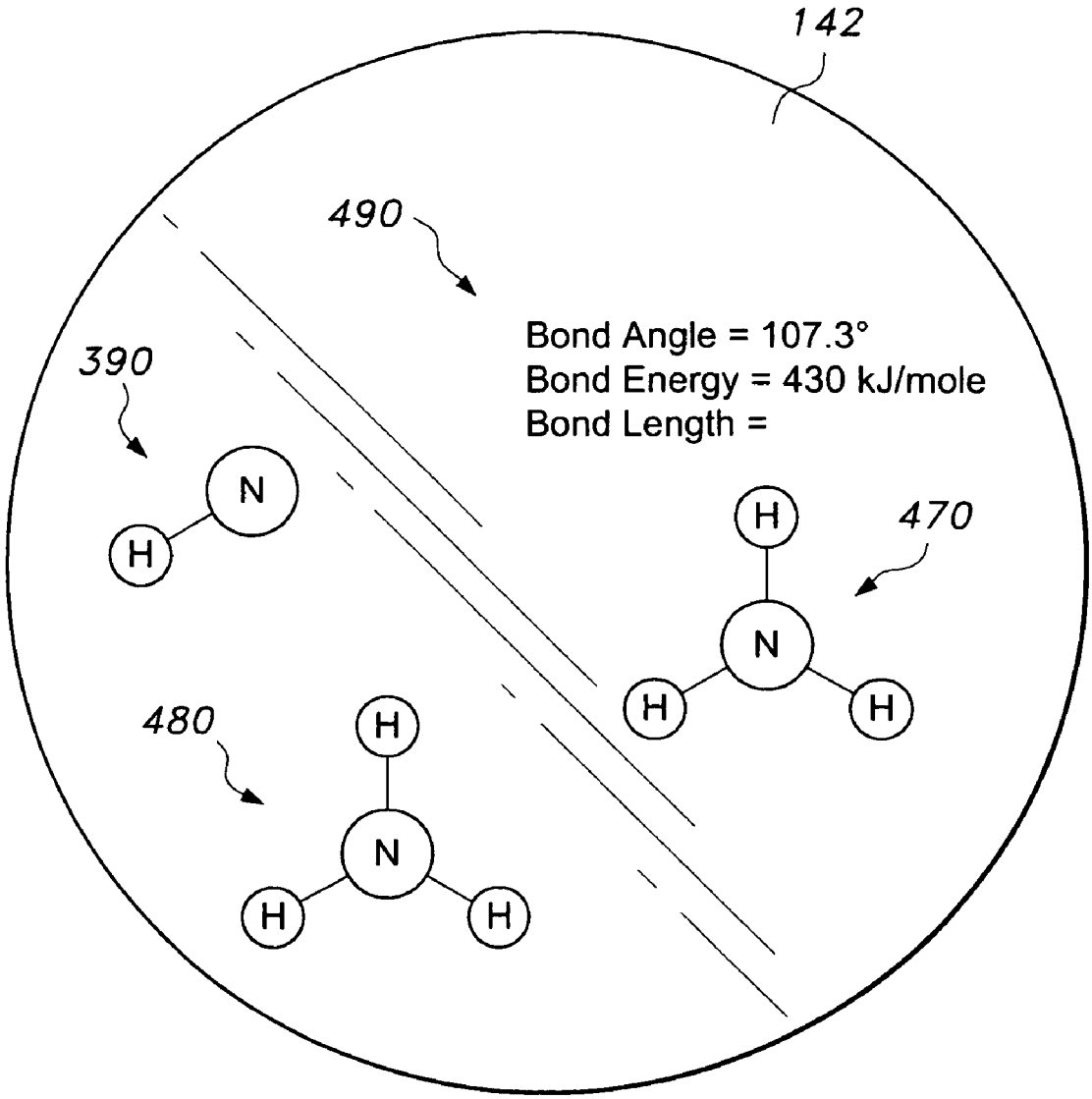
FIG. 21 is a top or front view of a device for displaying time according to the present invention, displaying time in the form of an hours group pattern and a minutes group pattern of another selectable display pattern.

The embodiment shown in FIG. 21 represents an educational display of the time. Though shown as a chemistry-related display, it should be understood that the user may select a display from any desired field of science or the arts. In this example, display groups 390, 470 and 480 each represent an ammonia molecule, with each atom representing one hour. It should be noted that group 390 does not show a full ammonia molecule yet, with one atom being added each hour.

Display group 490 represents the minute part of the time display, with each minute being represented by a word or character. Display group 490 includes word and numeric based information regarding the molecules displayed by display groups 390, 470 and 480. Counting the words, numbers and the equal signs, group 490 includes eleven elements, representing fifty-five minutes. The number of atoms included in groups 390, 470 and 480 total ten, thus the time display represents 10:55.

Figure 22B:
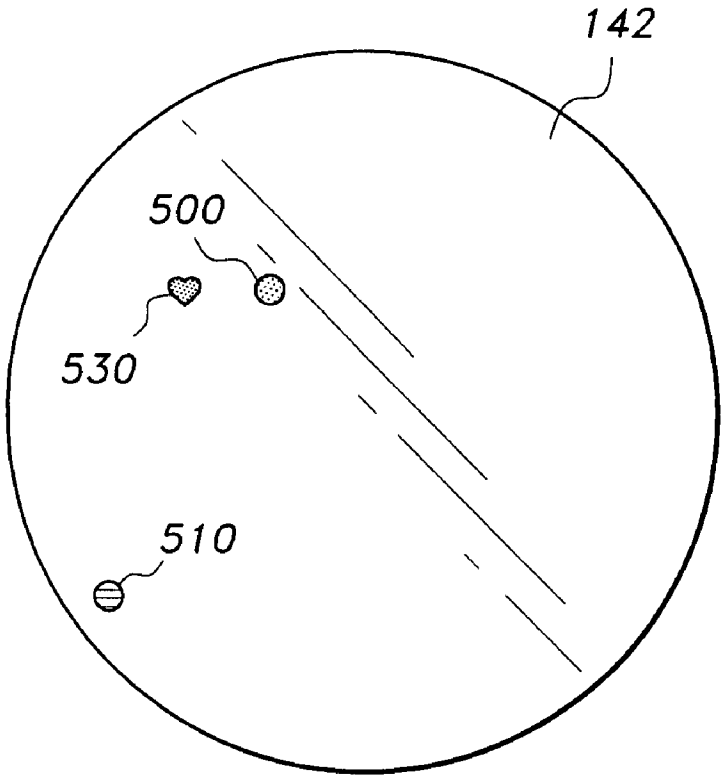
FIGS. 22A and 22B illustrate a top or front view of a device for displaying time according to the present invention, displaying time in the form of an hours group pattern and a minutes group pattern of another selectable display pattern with a threshold number of display elements being replaced by a single display element.
Figure 22A:
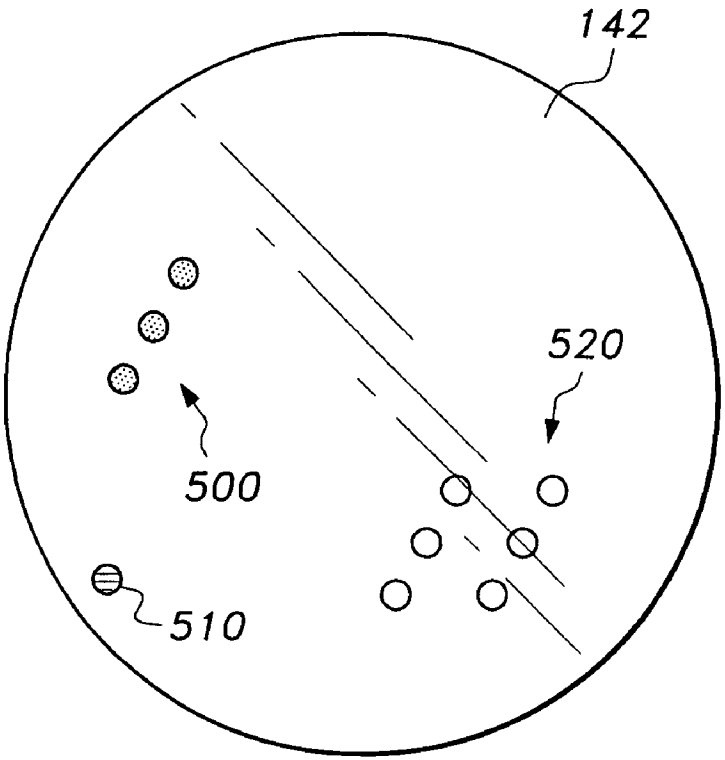

In FIG. 22A, a date is displayed in display area 142. In this representation, dots 500 represent months, dots 510 represent days and dots 520 represent groups of five days. As shown, dots 500, 510 and 520 each have separate texturing; the user may select any desired texturing, color or contour for the display elements in groups 500, 510 and 520. In this example, there are three dots in group 500, representing the third month, which is March. There are six dots in group 520, with each dot representing five days, plus one dot in group 510, which represents one day, thus making the date March 31.

In order to conserve display space, make the time displayed more readily available and interpretable, or to make the display more aesthetically pleasing to the user, the user may choose to set a threshold value for display elements, such that when, for example, the number of month dots exceeds three, the dots are replaced with a new symbol, which represents three dots. In the example shown in FIG. 22B, the heart representation 530 represents three dots 500. The choice of graphic representation and the threshold value is dependent upon the needs and desires of the user. In this example, there is one heart 530, which represents three months, and one dot 500, which represents one month. Thus, the month is April and the date, with one dot 510, is April 1. It should be understood that the user-selected threshold value may also be applied to the time display, as described above, and not only the date, as given in the example of FIGS. 22A and 22B.

Figure 23A:
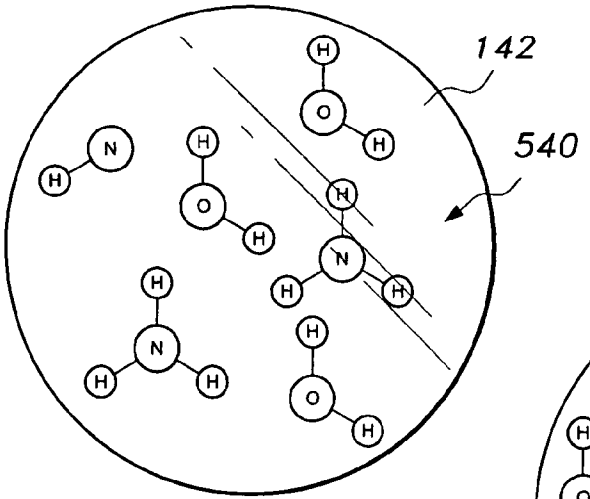
FIGS. 23A, 23B and 23C illustrate a top or front view of a device for displaying time according to the present invention, displaying time in the form of an hours group pattern and a minutes group pattern of another selectable display pattern, with the display elements simulating movement across the display screen of the device.
Figure 23B:
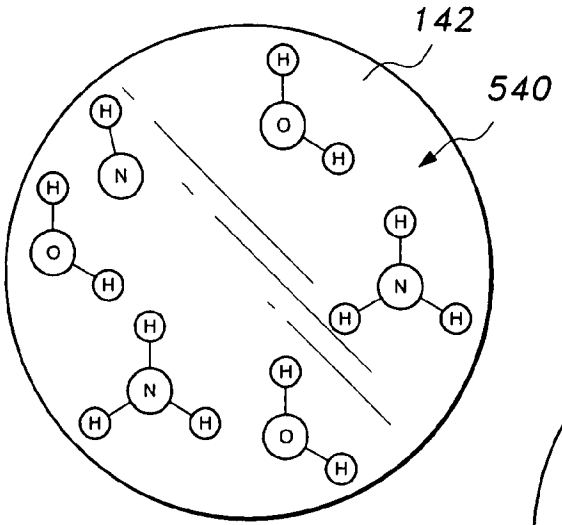
Figure 23C:
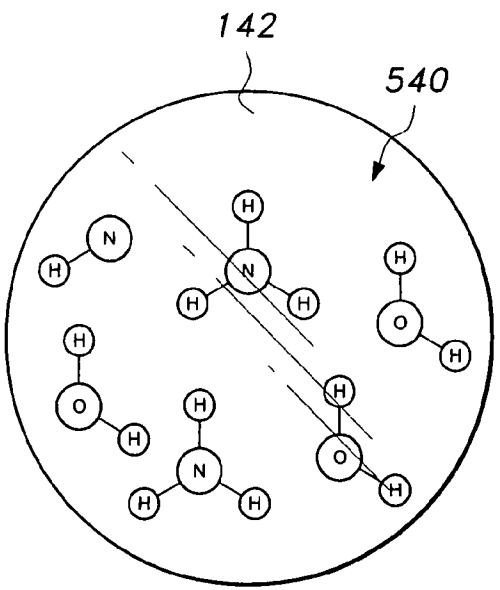

FIGS. 23A, 23B and 23C illustrate a time progression of moving display elements 540. The display elements utilized with display area 142 do not need to remain static; they may be set in motion, as shown. It should be noted that the number of atoms displayed in this example does not change between FIGS. 23A, 23B and 23C. At any given time during the interval in which this time should be displayed, the molecules are in motion but the time always reads the same.

Figure 24:
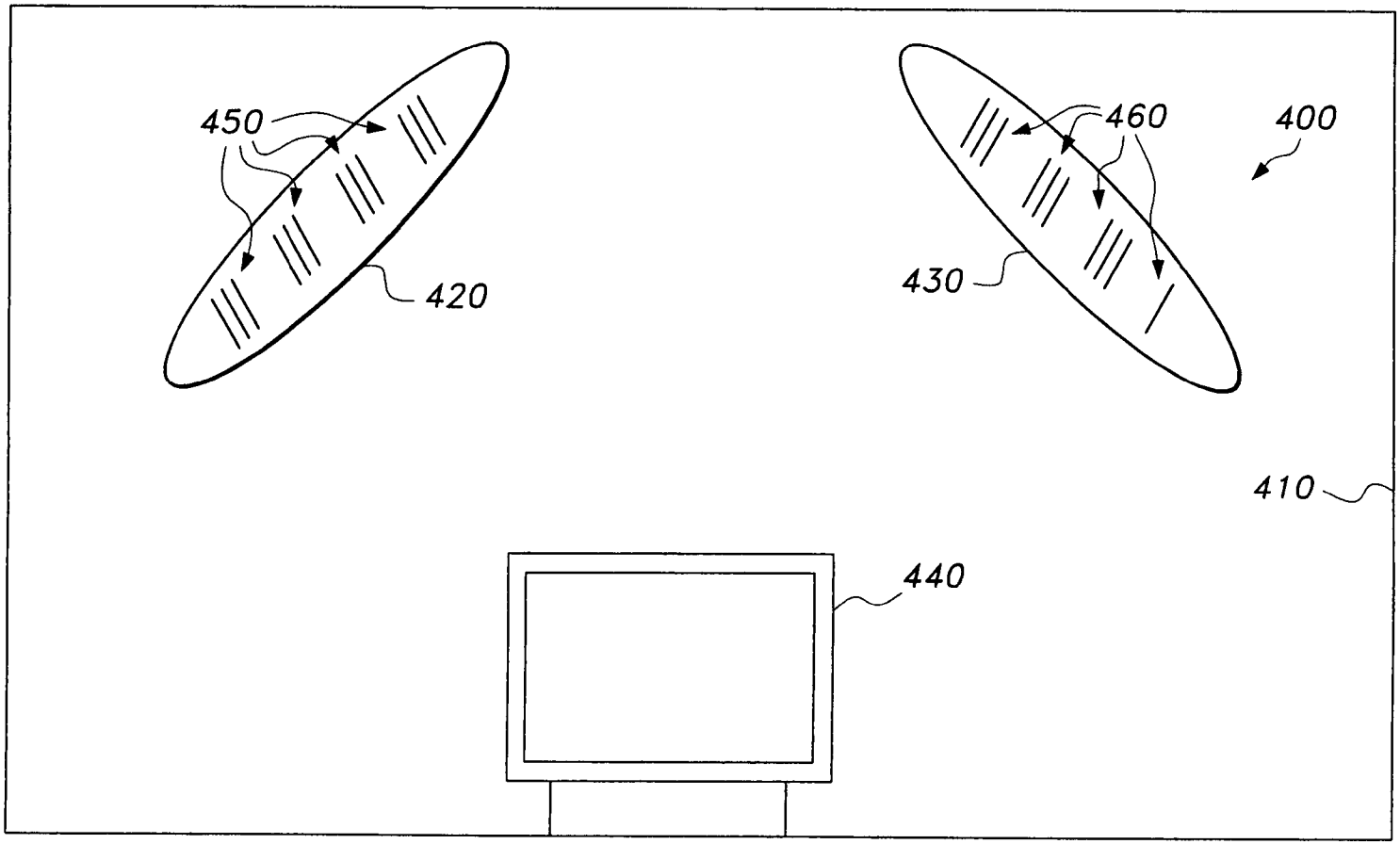
FIG. 24 is a simplified front environmental view of another alternative embodiment of the subject device for displaying time according to the present invention.

In the embodiment shown in FIG. 24, a large-scale time or date display system 400 is shown. Clocks 420 and 430 are mounted on a wall of a room 410 in the exemplary environment of FIG. 24. It should be understood that clocks or time pieces 420, 430 may be utilized in any suitable environment, depending upon the needs and desires of the user. Though shown as being symmetrically mounted about a television 440, it should be understood that this is for exemplary purposes only, and the user may mount clocks 420, 430, in this example, in any suitable manner.

Clock 420 displays the hour portion of the time and clock 430 displays the minute portion of the time. Display elements 450, 460 are shown here as being line segments, however, it should be understood that, as described above, the user may select any desired graphical representation for the display elements. In this example, clock 420 displays twelve line segments 450, representing twelve hours, and clock 430 displays ten line segments, with each line segment representing five minutes. Thus, the time displayed is 12:50. As noted above, the interval of time represented by a display element is dependent upon the needs and desires of the user.

As noted above, the clocks 420, 430 are part of an exemplary display and it should be understood that the principle of providing two separate time pieces which are located spatially apart from one another may be applied to clocks, watches or any other suitable time piece. As noted above, differing information may be displayed on the separate clocks 420, 430, or, alternatively, the clocks may display the same or similar information. Further, the separate clocks 420, 430 may form a continuum for a graphical representation, such as a moving scene which begins on one clock and ends on the other clock. The separate clocks may be used to display the time, the date or any other suitable user-selectable information or graphical representations.

It should be understood that the time pieces above may include watches, clocks, graphical display units, computer displays, screens embedded in watch bands, screens mounted on support surfaces or any other suitable time display. It should be further understood that the user may select any desired graphical representation for the display elements and may further select a particular desired arrangement for the display elements on the screen. For example, the user may select an arrangement of display elements representing minutes to be arranged about the circumference of the display area, and be positioned at the traditional 5 minute, 10 minute, 15 minute, etc. positions, or, as described above, the user may select other intervals, such as minute demarcations at the 2½ minute, 7½ minute, 12½ minute, etc. positions. Similarly, the user may choose to centrally locate the minute display elements; the choice of selection is dependent upon the needs and desires of the user.

It is to be understood that the present invention is not limited to the embodiments described above, but encompasses any and all embodiments within the scope of the following claims.

I claim:

1. A device adapted for displaying time in the form of a selectable non-analog, non-digital, non-binary, and non-numeric display pattern, comprising:

a storage device adapted for storing at least one selectable display pattern, wherein said at least one display pattern being a non-analog, non-digital, non-binary, and non-numeric representation of time;

an interface adapted for accepting at least one input from an operator, said interface selecting said at least one selectable display pattern from a plurality of distinct display patterns and being responsive to said at least one input;

a plurality of display elements located proximate to at least one display area, each of said display elements having a non-analog, non-digital, non-binary, and non- numeric, graphical representation associated therewith and each said display element being associated with a unit of time, said plurality of display elements being divided into a plurality of time sets, each of said time sets including at least one of said display elements, each said time set representing a time division selected from the group consisting of: years, months, days, hours, minutes and seconds; and, a display elements controller in communication with at least one time mechanism, said storage device, and said interface, wherein said controller displays said display elements associated with said selected display pattern;

wherein said display elements controller generates display signals for selectively activating said plurality of display elements, individual ones of said display elements associated with each said time set being activated to represent a particular time division, each said time set being visually distinct from others of said time sets displayed on said display area, wherein said display elements controller generates a motion signal to simulate movement of the entirety of said display elements with respect to one another and with respect to said display area, whereby the totality of display elements only provide an instantaneous visual non-analog, non-digital, non-binary, and non-numeric graphical presentation of time comprising at least two of said distinct time sets.

2. A method of displaying time in the form of a selectable non-analog, non-digital, non-binary, and non-numeric graphical display pattern, comprising the steps of:

providing a storage device adapted for storing at least one selectable display pattern, wherein said at least one display pattern being a non-analog, non-digital, non-binary, and non-numeric representation of time;

providing an interface adapted for accepting at least one input from an operator, said interface selecting said at least one selectable display pattern from a plurality of distinct display patterns and being responsive to said at least one input;

providing a first set of display elements having a first unit of time associated therewith, said first display elements being non-analog, non-digital, non-binary and non-numeric graphical display elements;

providing a second set of display elements having a second unit of time associated therewith, said second display elements being non-analog, non-digital, non- binary and non-numeric graphical display elements;

generating a signal associated with a time, said time being measured in said first and second units of time;

selectively activating a first discrete number of said display elements of said first set and a second discrete number of said display elements of said second set, said first discrete number and said second discrete number representing said time; and generating a movement signal to graphically simulate motion of the entirety of said first and second sets of display elements.

* * * * *